US007849633B2

(12) United States Patent
Oshima et al.

(10) Patent No.: US 7,849,633 B2
(45) Date of Patent: Dec. 14, 2010

(54) DEVICE FOR GUIDING PLATE-LIKE OBJECT

(75) Inventors: Kazuyoshi Oshima, Naruto-machi (JP); Hiroyuki Masuda, Hikata-machi (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 855 days.

(21) Appl. No.: 10/555,720

(22) PCT Filed: Apr. 28, 2004

(86) PCT No.: PCT/JP2004/006143

§ 371 (c)(1),
(2), (4) Date: Nov. 7, 2005

(87) PCT Pub. No.: WO2004/099540

PCT Pub. Date: Nov. 18, 2004

(65) Prior Publication Data

US 2007/0033878 A1 Feb. 15, 2007

(30) Foreign Application Priority Data

May 7, 2003 (JP) ..... 2003-128816

(51) Int. Cl.
*E05D 15/10* (2006.01)

(52) U.S. Cl. ..... 49/209; 49/212; 49/216; 49/218; 49/404

(58) Field of Classification Search ..... 49/208, 49/209, 212, 216, 217, 218, 221, 223, 260, 49/404, 425
See application file for complete search history.

(56) References Cited

U.S. PATENT DOCUMENTS 3,906,668 A * 9/1975 Simmons ..... 49/212

(Continued)

FOREIGN PATENT DOCUMENTS

AT 339-531 10/1997

(Continued)

OTHER PUBLICATIONS

International Search Report issued by the European Patent Office in Application No. PCT/JP2004-006143 dated Aug. 29, 2008, 3 pages.

(Continued)

*Primary Examiner*—Katherine W Mitchell
*Assistant Examiner*—Catherine A Kelly
(74) *Attorney, Agent, or Firm*—Osha • Liang LLP

(57) ABSTRACT

A plurality of sliding doors 3 arranged side by side to close an opening of a frame 1. The sliding doors 3 are flush with each other. A rotatable link 50 is disposed in an upper edge portion of an opening section 2*x*. The rotatable link 50 has a short rail portion 51 formed at a distal end thereof. A roller 15 is disposed in an upper edge portion of the sliding door 3. The roller 15 rides on the rail portion 51. When the sliding door 3 moves from a closed position to an opening preparation position in a front or rear direction, the rotatable link 50 rotates from a first rotation position to a second rotation position, thereby positioning the rail portion 51 coaxial with a fixed rail 39. The sliding door 3 is provided with a rail member 11. The rail member 11 of the sliding door 3 in the closed position is coaxial with the fixed rail 39. The roller 15 of the sliding door 3 moving to an open position runs on the rail member 11 of the sliding door 3 in the closed position and the fixed rail 39.

22 Claims, 29 Drawing Sheets

U.S. PATENT DOCUMENTS

| | | | | |
|---|---|---|---|---|
| 4,462,185 | A * | 7/1984 | Shibuki et al. | 49/218 |
| 4,551,945 | A * | 11/1985 | von Resch | 49/221 |
| 4,644,690 | A * | 2/1987 | Caimi | 49/130 |
| 5,483,769 | A * | 1/1996 | Zweili | 49/118 |
| 5,735,080 | A * | 4/1998 | Pratolongo | 49/209 |
| 5,896,704 | A * | 4/1999 | Neag et al. | 49/209 |
| 5,921,613 | A * | 7/1999 | Breunig et al. | 296/155 |
| 6,385,910 | B1 * | 5/2002 | Smink et al. | 49/218 |
| 6,792,717 | B2 * | 9/2004 | Carlsson et al. | 49/218 |
| 6,926,342 | B2 * | 8/2005 | Pommeret et al. | 296/155 |
| 7,426,803 | B2 * | 9/2008 | Fronz et al. | 49/209 |

FOREIGN PATENT DOCUMENTS

| | | |
|---|---|---|
| DE | 36 19775 | 12/1987 |
| GB | 1 375 414 | 11/1974 |
| JP | 43-31658 Y1 | 12/1968 |
| JP | 57111678 | 7/1982 |
| JP | 59-26066 | 7/1984 |
| JP | 1-151681 A | 6/1989 |
| JP | 1-151681 A | 6/1989 |
| JP | 5-51753 | 8/1993 |
| JP | 7-269217 | 10/1995 |

OTHER PUBLICATIONS

Patent Abstracts of Japan, Publication No. 01151681 dated Jun. 14, 1989, 1 page.

ISA/JP, International Search Report, PCT/JP2004/006143, Aug. 24, 2004, 2 pages.

Patent Abstracts of Japan for 07-269217 (1 page), dated Oct. 17, 1995.

Patent Abstracts of Japan for 01-151681 (1 page), dated Jun. 14, 1989.

Japanese Office Action issued in JP Application No. 2005-505998 dated Jan. 13, 2009 with English Translation (7 pages).

* cited by examiner

Figure 2 ( A )
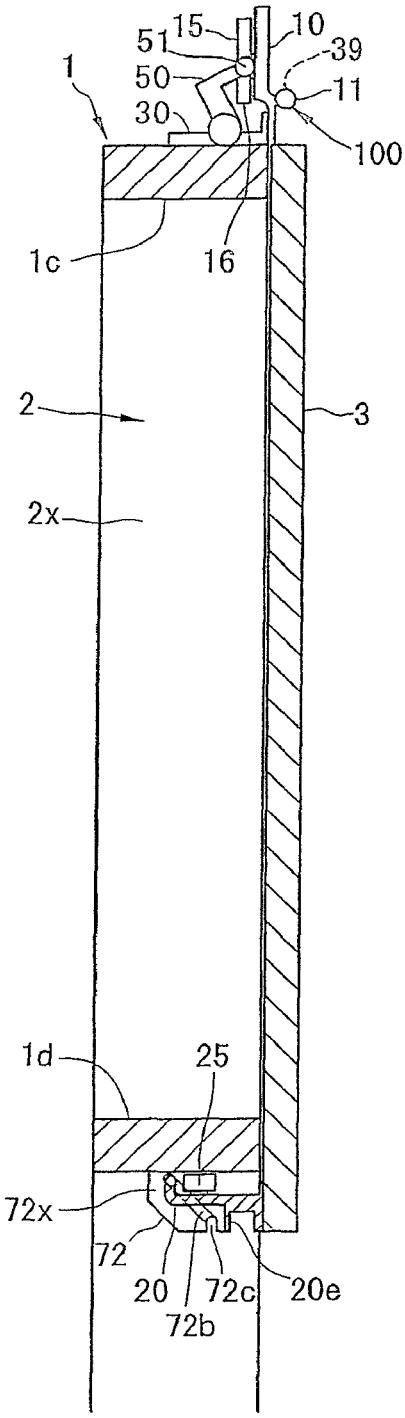
Figure 2 ( B )
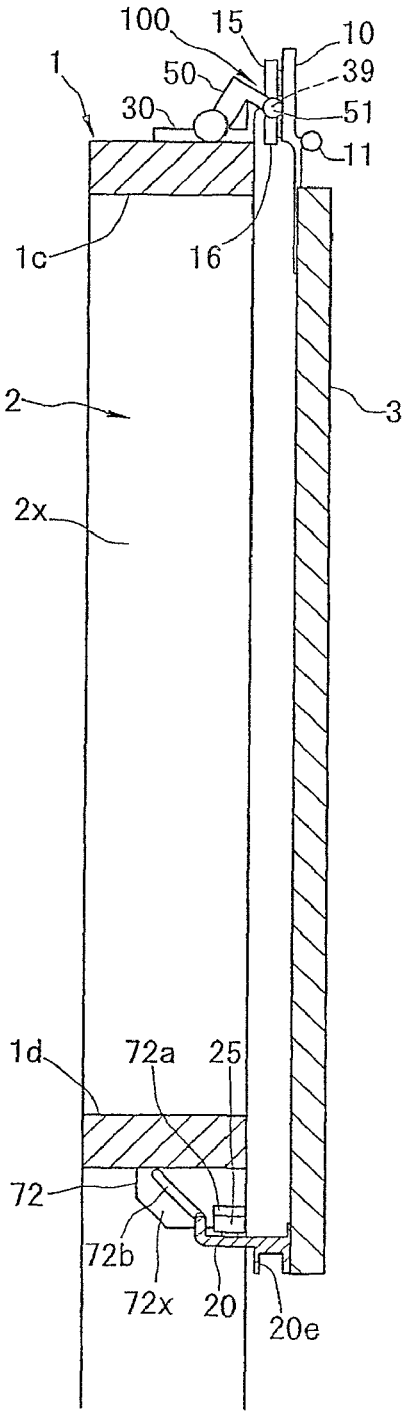

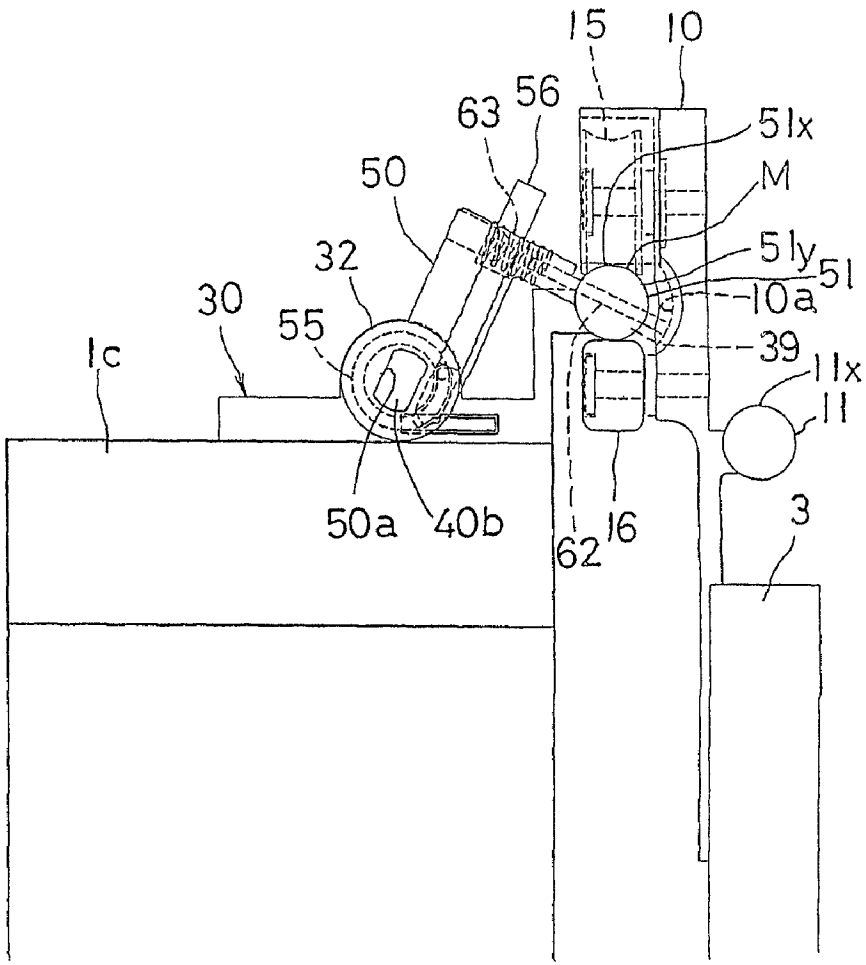
Figure 7 ( B )
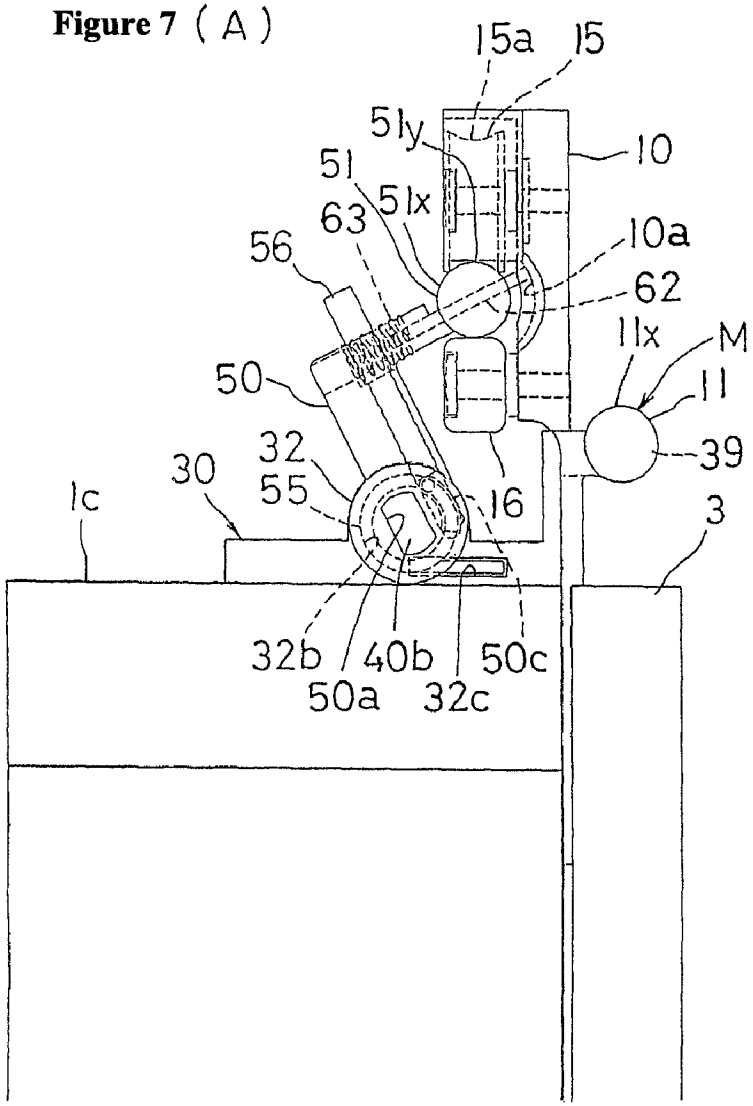
Figure 7 ( A )

Figure 10 ( A )
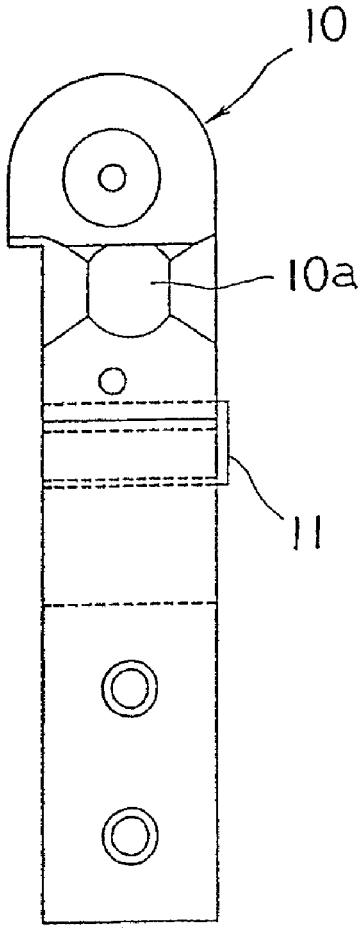
Figure 10 ( B )
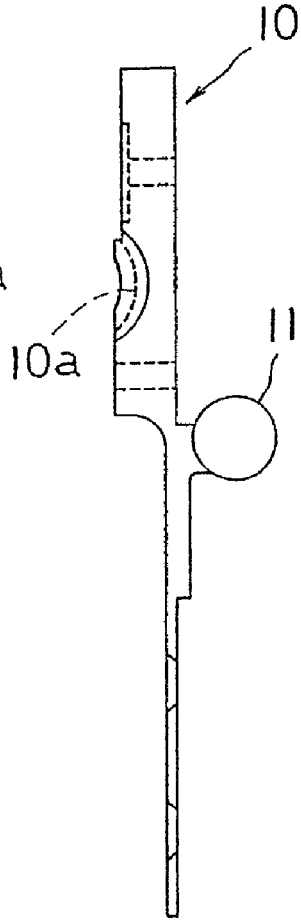

Figure 11 ( A )
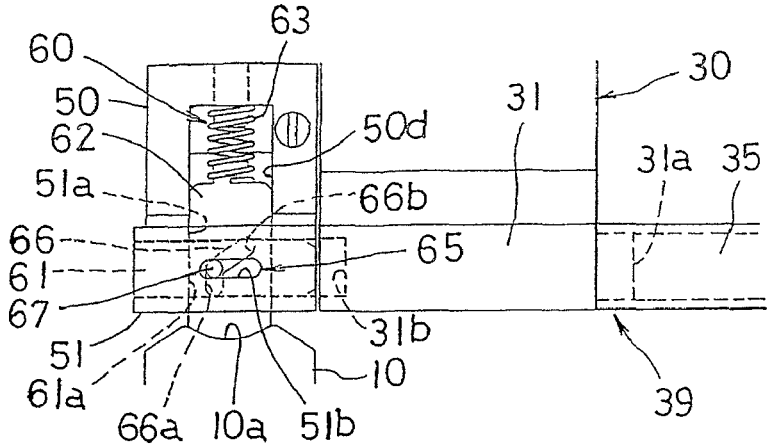
Figure 11 ( B )
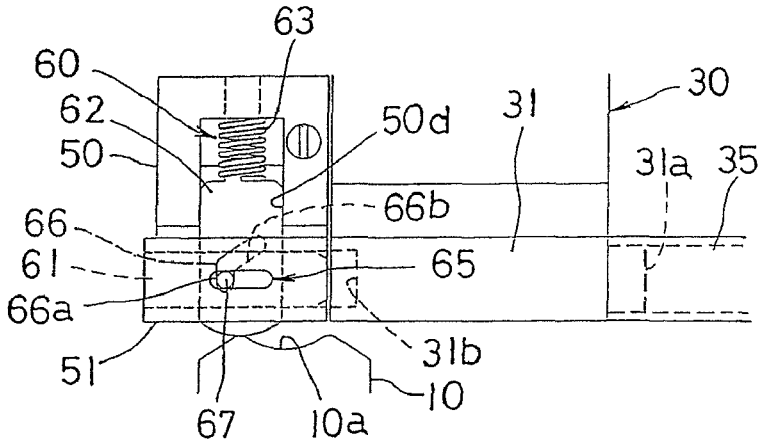
Figure 11 ( C )
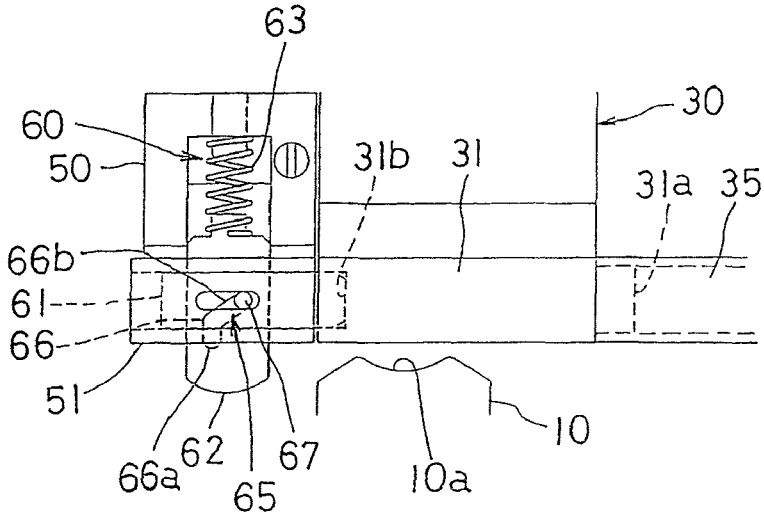

Figure 13 ( B )
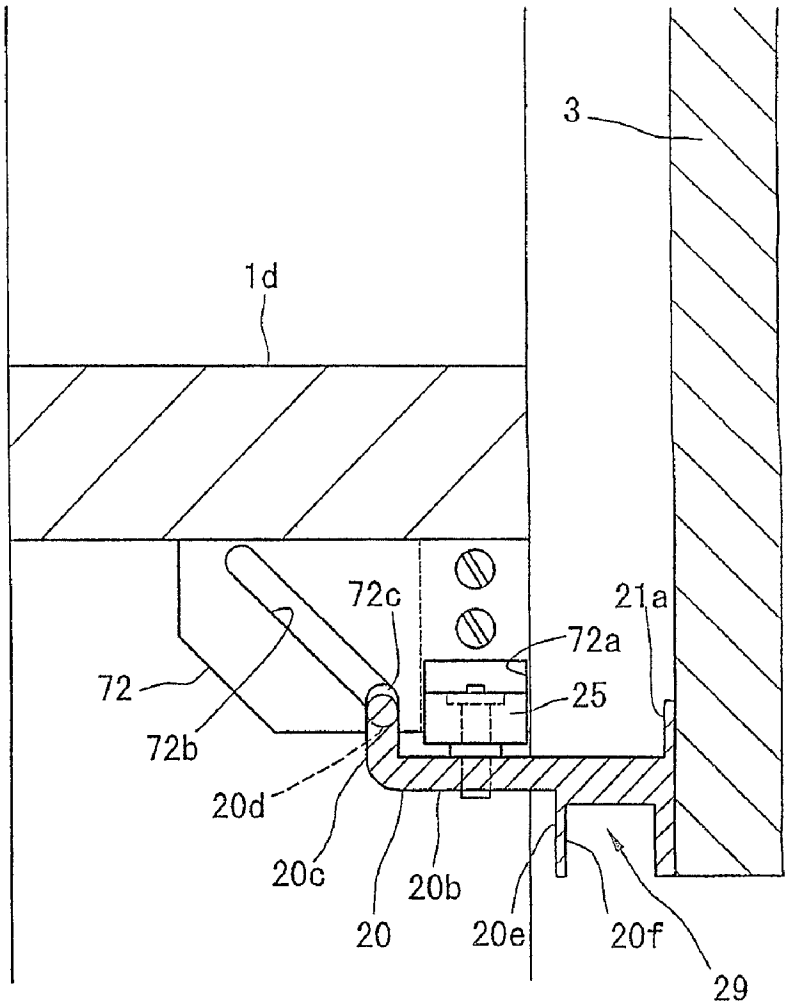
Figure 13 ( A )
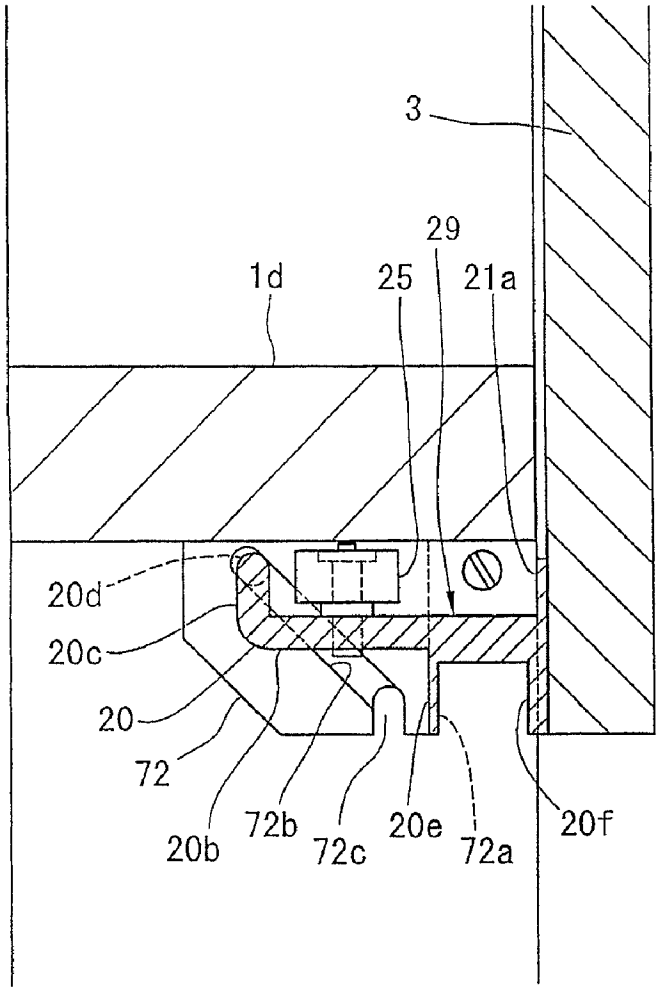

Figure 14 ( A )
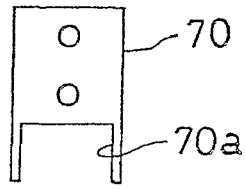
Figure 14 ( B )
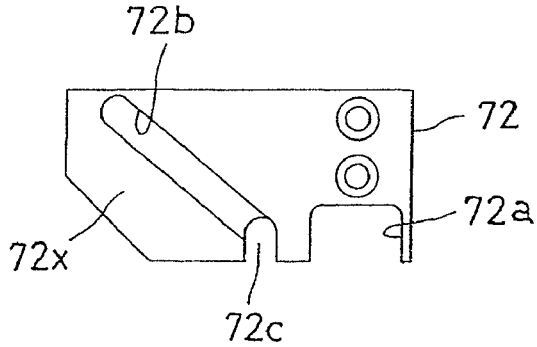
Figure 14 ( C )
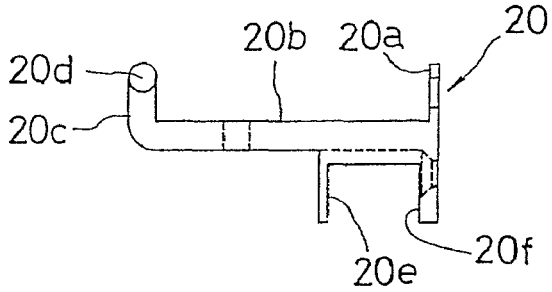
Figure 15
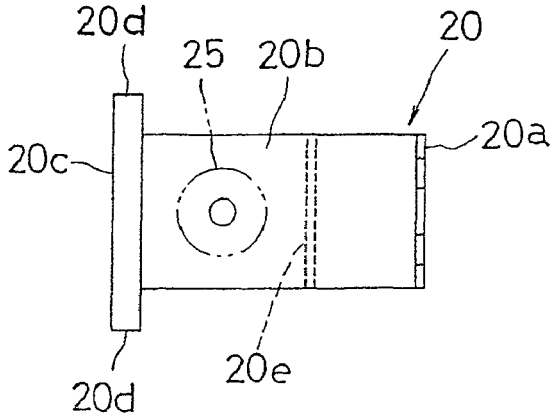

Figure 20 ( A )
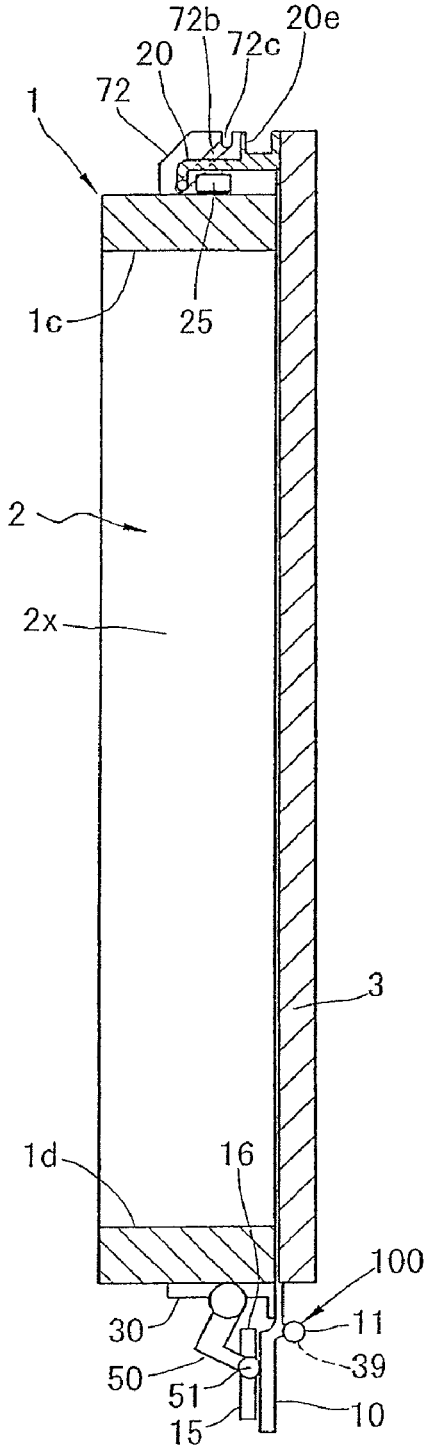
Figure 20 ( B )
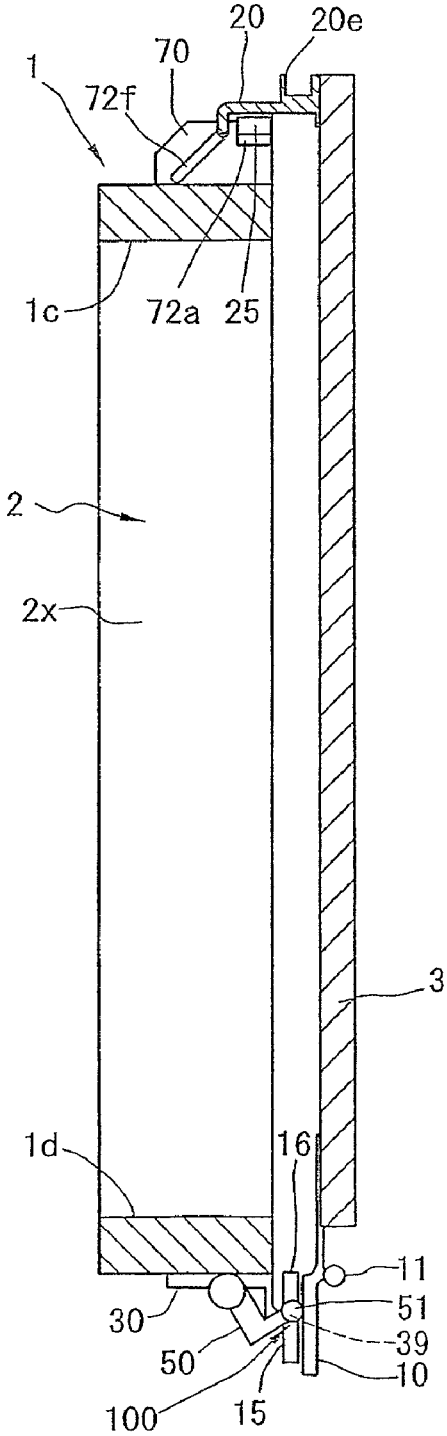

( A )

( B )

DEVICE FOR GUIDING PLATE-LIKE OBJECT

TECHNICAL FIELD

This invention relates to a guide apparatus for guiding one or a plurality of plate-like objects in a left and right direction.

BACKGROUND ART

Sliding doors (plate-like object) open and close an opening of a window or furniture by moving in a left and right direction, often guided by a guide apparatus. Well-known are guide apparatus which open an opening by guiding the sliding door from a closed position (set position) to an opening preparation position (preparation position) located in front of or behind the closed position, and then from the opening preparation position to an open position (non-set position) located to the left or right of the opening preparation position.

Japanese Patent Application Laid-Open No. H7-269217 discloses an opening and closing apparatus for a window of a house. The opening and closing apparatus comprises two identically-shaped doors. One of the doors is immovably fixed in the right side of the window. The other, being provided as a sliding door, is movable in a left and right direction and opens and closes an opening adjacent to the fixed door. When the sliding door is in a closed position, it is flush with the fixed door providing a good appearance. To open the opening, the sliding door is pulled to the front from the closed position to an opening preparation position and moved to an open position, where it is overlapped with the fixed door located in the right direction. To close the opening, in the reverse order, the sliding door is moved from the open position to the opening preparation position in the left direction and pushed to the rear to the closed position, where it is flush with the fixed door. A guide apparatus for bringing about such a sliding door movement comprises rails disposed on upper and lower edges of a window, upper and lower runners which run along the rails and pantograph mechanisms for connecting the runners to upper and lower edges of the sliding door respectively. The pantograph mechanisms are folded when the sliding door is in the closed position. When the sliding door is pulled to the front, the pantograph mechanisms extend and the sliding door is moved to the open position being supported by the extended pantograph mechanisms.

Japanese Utility Model Publication No. S59-26066 discloses furniture including three sliding doors. Sliding doors at the left and right move guided along first tracks disposed on upper and lower edges of the opening to open and close left and right opening sections, respectively. A sliding door in the middle moves guided along second tracks disposed on upper and lower edges of the opening to open and close a middle opening section. The second tracks are parallel to the first tracks and located behind the first tracks. Upper and lower runners which run on the second track are connected to upper and lower edges of the sliding door in the middle respectively by means of pantograph mechanisms. When the sliding door in the middle is in a closed position being flush with the sliding doors to the left and right, the pantograph mechanism is extended. When the sliding door in the middle is pushed to the rear, the pantograph mechanism is folded, which enables the sliding door to move to left and right open positions.

In apparatus disclosed in Japanese Patent Application Laid-Open No. H7-269217 and Japanese Utility Model Publication No. S59-26066 as described above, the complex pantograph mechanism exists between the sliding door and the runners. Since the pantograph mechanism constantly supports load of the sliding door including when the door is moving to the open position, it is prone to failure.

DISCLOSURE OF THE INVENTION

The present invention has been accomplished in view of the above-mentioned problem. According to the present invention, there is provided a guide apparatus for guiding a movement of a plate-like object with respect to a main body between a set position and a preparation position in front of or behind the set position, and between the preparation position and a non-set position to the left or right of the preparation position, comprising:

(a) a runner mounted on at least one of upper and lower edge portions of the plate-like object;

(b) a main rail including a main track, the main track extending to the left and right, and the main rail supporting the plate-like object in the non-set position in such a way that the runner rides on the main track; and, (c) a rotatable member supported by the main body so that the rotatable member can rotate between a first rotation position and a second rotation position about a rotation axis extending to the left and right, including a supporting surface and an auxiliary track, supporting the plate-like object in the set position in such a way that the runner rides on the supporting surface when the rotatable member is in the first rotation position, and supporting the plate-like object in the preparation position in such a way that the runner rides on the auxiliary track, which becomes continuous with the main track, when the rotatable member is in the second rotation position.

According to the features of the present invention as mentioned above, the plate-like object is supported in the set position or in the preparation position by means of the rotatable member disposed on the main body. Therefore, a complex mechanism such as a pantograph mechanism is not required, which means that the apparatus is less likely to fail.

The guide apparatus according to the present invention may be used as an opening and closing apparatus for opening and closing a window or furniture or the like. The main body has an opening formed therein. The opening is closed by the plate-like object in the set position and the opening is open when the plate-like object is in the non-set position.

Preferably, the guide apparatus comprises a holding mechanism for holding the rotatable member in the second rotation position. This feature allows the plate-like object to return smoothly from the non-set position to the preparation position.

In one embodiment of the present invention, the rotatable member has a rail portion formed on a distal edge thereof, the rail portion having a substantially circular cross-section and extending parallel to the main track. The supporting surface comes to the top of a circumferential surface of the rail portion when the rotatable member is in the first rotation position. The auxiliary track comes to the top of the circumferential surface of the rail portion when the rotatable member is in the second rotation position. The runner includes a fitting groove into which the rail portion is to be fitted. This arrangement enables the rotatable member to engage securely with the plate-like object and to follow the plate-like object when the plate-like object moves between the set position and the preparation position. This arrangement further simplifies the structure of the guide apparatus.

In the above-mentioned embodiment, preferably, the guide apparatus further comprises a biasing member for biasing the rotatable member to the first rotation position and thus biasing the plate-like object to the set position. This enables the plate-like object to be securely held at the set position.

One or a plurality of the plate-like objects may be provided in the above-mentioned embodiment. When a plurality of the plate-like objects are provided, all of the plate-like objects are flush with each other when they are all in the set position and arranged side by side with each other. Each of the plate-like objects is provided with a rail member including an additional track of the same length as the auxiliary track of the rotatable member. The rail member of each one of the plate-like objects in the set position serves as at least a part of the main rail for the other of the plate-like objects. This arrangement enables the plate-like objects to move to the non-set position, overlapped with the other plate-like objects in the set position.

The main body is provided with a fixed rail extending to the left and right. The main rail comprises the fixed rail and the rail member of the plate-like object in the set position. Alternatively, the main rail is composed solely of the rail member of the plate-like object in the set position, in which case the length of the rail member of the plate-like object is generally the same as the width of the plate-like object.

In another embodiment of the present invention, the rotatable member includes a receiving groove parallel to the main track. An inner surface of the receiving groove includes the supporting surface and the auxiliary track. The runner is received in the receiving groove when the plate-like object is in the set position and in the preparation position. This arrangement enables the rotatable member to engage securely with the plate-like object and to follow the plate-like object when the plate-like object moves between the set position and the preparation position.

In the above-mentioned embodiment, preferably, a runner support bracket is rotatably mounted on the plate-like object in such a way that the runner support bracket can rotate about another rotation axis extending to the left and right and the runner is supported in the runner support bracket. More preferably, the runner is of a disc shape and is turnably supported in a distal end portion of the runner support bracket, so that the runner lies down with a side surface thereof abutting the supporting surface of the guide groove when the rotatable member is in the first rotation position and the runner stands up with a circumferential surface thereof abutting the auxiliary track when the rotatable member is in the second rotation position. This arrangement enables the disc shaped runner to transfer smoothly from the auxiliary track to the main track when the plate-like object moves from the preparation position to the non-set position.

Preferably, the another rotation axis of the runner support bracket is located behind the rotation axis of the rotatable member when the rotatable member is in the first rotation position, and the another rotation axis of the runner support bracket is located in front of the rotation axis of the rotatable member when the rotatable member is in the second rotation position. This arrangement reduces the amount of vertical displacement of the plate-like object accompanying the movement of the plate-like object between the set position and the preparation position.

Preferably, the guide apparatus further comprises a biasing member which applies rotation torque to the runner support bracket, thereby biasing the plate-like object to the set position. This arrangement enables the plate like object to be securely maintained in the set position.

When a plurality of the plate-like objects are provided, all of the plate-like objects are flush with each other when they are all in the set position and arranged side by side with each other. A plurality of the rotatable members correspond to the plate-like objects respectively, each of the rotatable members including an additional track of the same length as the auxiliary track. The additional track of the rotatable member corresponding to each one of the plate-like objects serves as at least a part of the main rail for the other of the plate-like objects when the rotatable member is in the first rotation position. This arrangement enables the plate-like object to move to the non-set position overlapped with the other plate-like objects in the set position.

Preferably, the rotatable member is generally of the same length as the plate-like object and the main track is composed solely of the additional track of the rotatable member corresponding to the plate-like object in the set position. This simplifies the construction of the guide apparatus.

When a plurality of the plate-like objects are provided, all of the plate-like objects are flush with each other when they are all in the set position and arranged side by side with each other. The runner support bracket is mounted on each of the plate-like objects. The runner support bracket includes an additional track of the same length as the auxiliary track. The additional track of the runner support bracket corresponding to each one of the plate-like objects serves as at least a part of the main rail for the other of the plate-like objects when the rotatable member is in the first rotation position. This arrangement enables the plate-like object to move to the non-set position, overlapped with the other plate-like objects in the set position.

In a case where the runner is disposed in an upper edge portion of the plate-like object, the plate-like object is suspendedly supported by the rotatable member when the plate-like object is in the set position or in the preparation position. It is not necessary to restrict back and forth movements of the plate-like object at the lower edge of the plate-like object.

Preferably, the runner is disposed in either the upper or lower edge portion of the plate-like object and serves as a main runner, with a secondary runner being disposed in the other of the upper and lower edge portions of the plate-like object. The guide apparatus further comprises a guide member which guides the secondary runner when the plate-like object moves between the set position and the preparation position and a secondary rail which guides the secondary runner when the plate-like object moves between the preparation position and the non-set position. This arrangement enables the guide apparatus to guide the plate-like object more securely.

Preferably, the secondary runner includes a projection projecting at least either to the left or right and the guide member includes a guide groove which guides the projection. This arrangement enables the guide apparatus to guide the plate-like object securely by means of the secondary runner when the plate-like object moves between the set position and the preparation position.

Preferably, the secondary runner includes a running portion which runs in a groove formed in the secondary rail and a running portion support bracket which is mounted on the plate-like object to support the running portion, and the running portion support bracket is provided with the projection.

In a case where the plate-like object moves upward or downward while it moves between the set position and the preparation position, the guide groove of the guide member is linearly inclined corresponding to the displacement of the plate-like object.

Preferably, the guide member includes a vertical groove continuous with the guide groove. The projection of the secondary runner is received in the vertical groove when the plate-like object is in the set position. This arrangement enables the plate-like object to be securely maintained in the set position.

In a case where the plate-like object takes the highest or the lowest position while moving from the set position to the preparation position, the guide groove includes a horizontal portion extending in a front and rear direction and a back end portion extending upward or downward from a rear end of the horizontal portion. This arrangement enables the height of the guide member to be reduced.

In a case where a plurality of the plate-like objects are provided, all of the plate-like objects are flush with each other when they are all in the set position and arranged side by side with each other. The secondary runner includes a rail portion which is continuous with the secondary rail when the plate-like object is in the set position. This arrangement enables the plate-like object to move to the non-set position, overlapped with the other plate-like objects in the set position.

BRIEF DESCRIPTION OF THE DRAWINGS

FIG. 1(A) illustrates the partition when all the sliding doors are closed. FIG. 1(B) illustrates the partition when one of the sliding doors is pulled to the front from a closed position to an opening preparation position. FIG. 1(C) illustrates the partition when one of the sliding doors is in the course of moving from the opening preparation position to an open position.

FIG. 2(A) is a vertical sectional view of FIG. 1(A) taken along line IIa-IIa. FIG. 2(B) is a vertical sectional view of FIG. 1(B) taken along line IIb-IIb.

FIG. 7 is an enlarged side view of the upper structure of the guide apparatus. FIG. 7(A) illustrates the upper structure when the sliding door is in the closed position. FIG. 7(B) illustrates the upper structure when the sliding door is in the opening preparation position.

FIG. 10 is an enlarged view of a support bracket mounted on the sliding door of the guide apparatus. FIG. 10(A) is a rear view and FIG. 10(B) is a side view of the support bracket.

FIG. 11 is an enlarged plan view of a holding mechanism of the rotatable link of the guide apparatus. FIG. 11(A) illustrates the holding mechanism when the rotatable link is in a first rotation position, which is taken when the sliding door is in the closed position. FIG. 11(B) illustrates the holding mechanism when the rotatable link is in a second rotation position, which is assumed when the sliding door is in the opening preparation position. FIG. 11(C) illustrates the holding mechanism when the rotatable link is held in the second rotation position, when the sliding door is moved from the opening preparation position to the open position.

FIG. 13 is a cross-sectional view of a lower structure of the guide apparatus. FIG. 13(A) illustrates the lower structure when the sliding door is in the closed position. FIG. 13(B) illustrates the lower structure when the sliding door is in the opening preparation position.

FIG. 14(A) is an enlarged side view of a secondary rail of the lower structure. FIG. 14(B) is an enlarged side view of a guide plate of the lower structure. FIG. 14(C) is an enlarged side view of a support bracket of the lower structure.

FIG. 15 is a plan view of the support bracket of the lower structure.

FIG. 20 is a vertical sectional view of a guide apparatus according to a sixth embodiment of the present invention. FIG. 20(A) illustrates the guide apparatus when the sliding door is in the closed position. FIG. 20(B) illustrates the guide apparatus when the sliding door is in the opening preparation position.

BEST MODE FOR CARRYING OUT THE INVENTION

Figure 1:
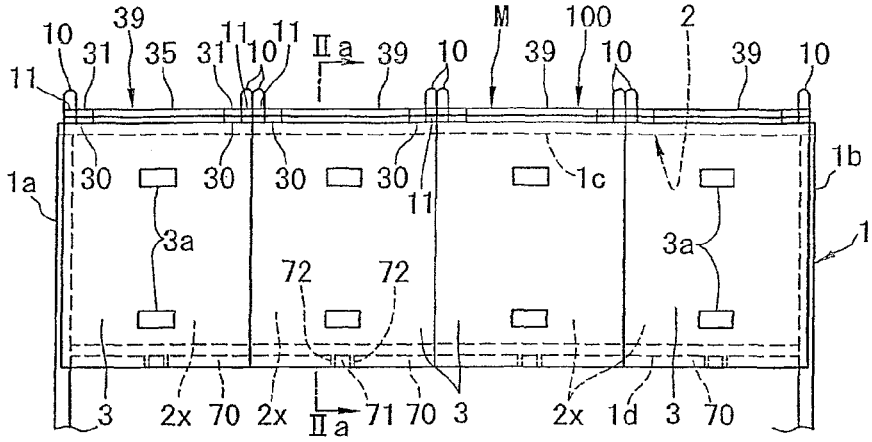
FIG. 1 is a front view of a partition incorporating a guide apparatus for sliding doors according to one embodiment of the present invention.
Figure 1:
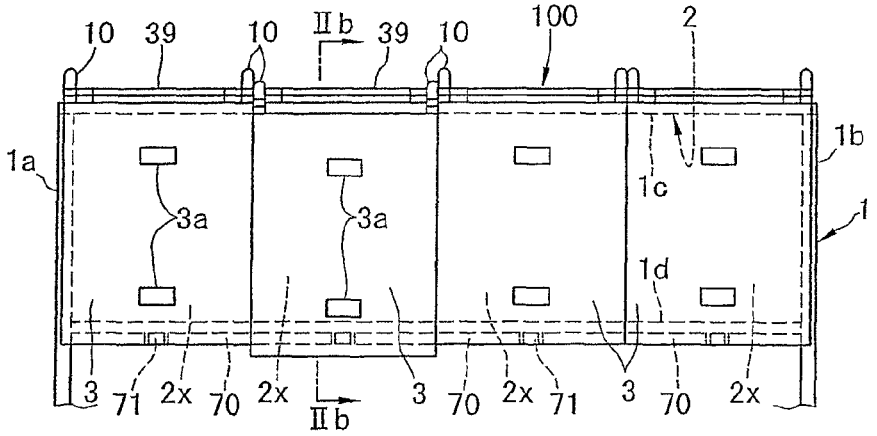
Figure 1:
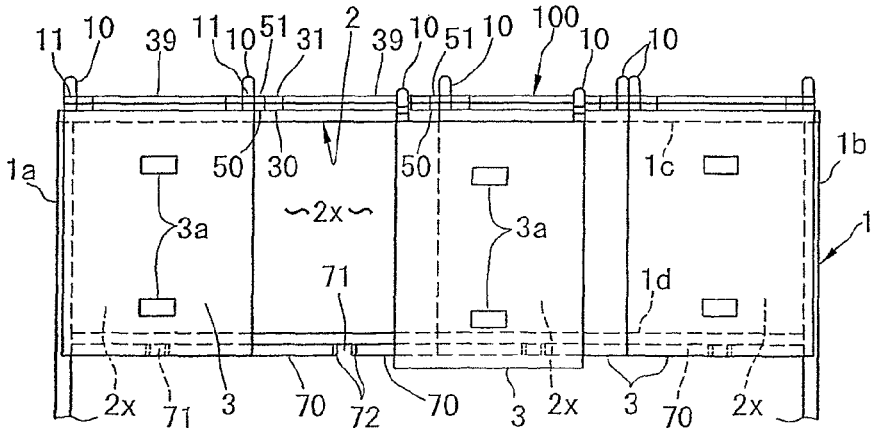

A first embodiment of the present invention will now be described with reference to FIGS. 1 to 15. A partition shown in FIG. 1 is portable and used for dividing space such as in a room. The partition includes a horizontally rectangular frame 1 (main body). Left and right frame portions 1*a*, 1*b* of the frame 1 extends vertically serving as support columns, with lower ends thereof fixed on bases (not shown) placed on a floor.

A horizontally long opening 2 defined by the frame 1 is closed by a plurality of (four, for example) sliding doors 3 (plate-like objects) arranged side by side with each other. The sliding doors 3 are composed of vertically rectangular plates of the same dimensions with pulls 3*a* attached on a front surface thereof. The pulls 3*a* are grabbed and the sliding door 3 is pulled out of a closed position (set position) to an opening preparation position (preparation position) located in front and then moved to the left or right to be opened. An area of the opening 2 corresponding to each of the sliding doors 3 is referred to as an opening section 2*x*. Four opening sections 2*x* are continuous. In this embodiment, each of the sliding doors 3 can move from the left end to the right end of the frame 1.

Figure 3:
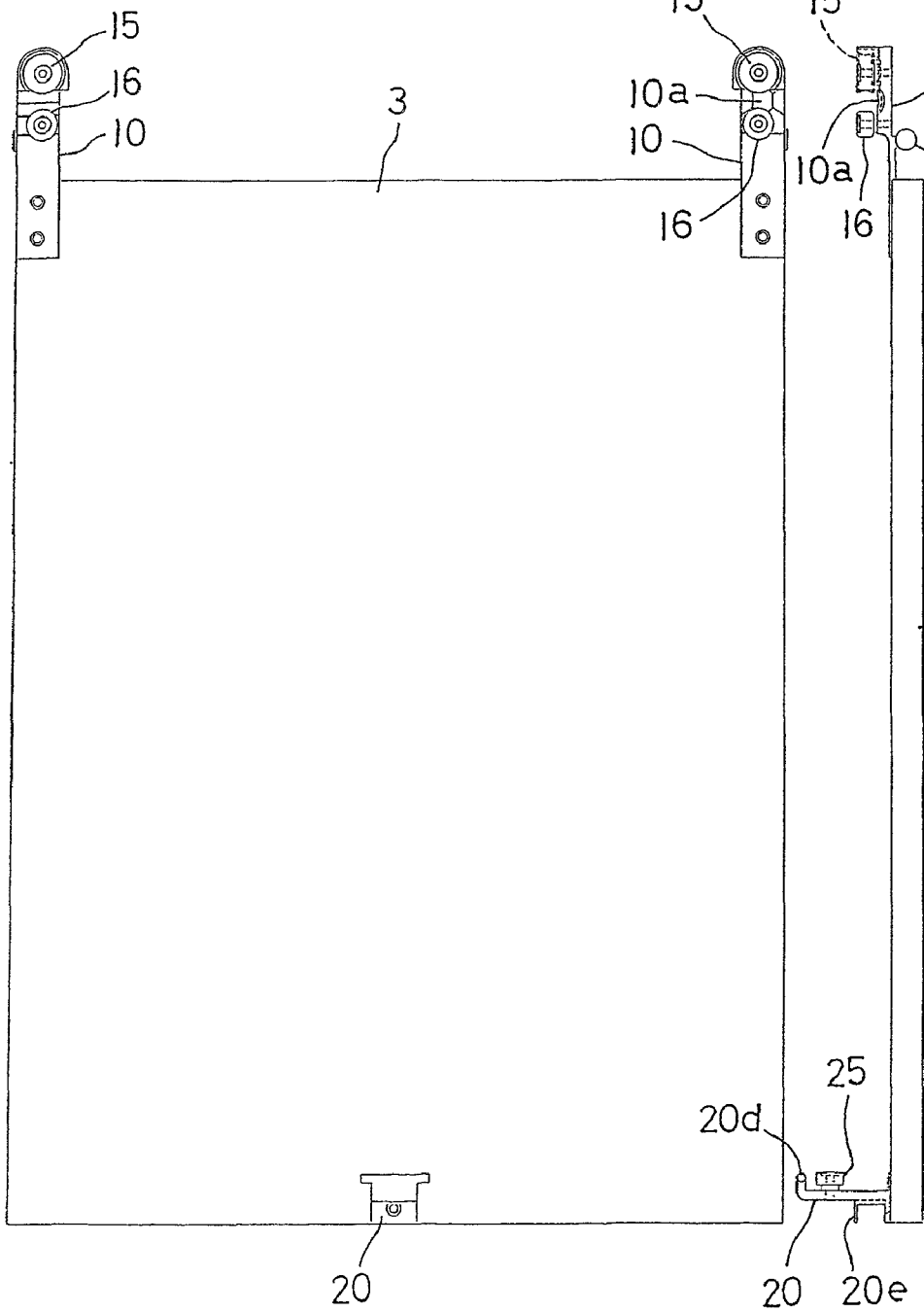
FIG. 3(A) is a rear view of the sliding door.
FIG. 3(B) is a side view of the sliding door.
Figure 3:
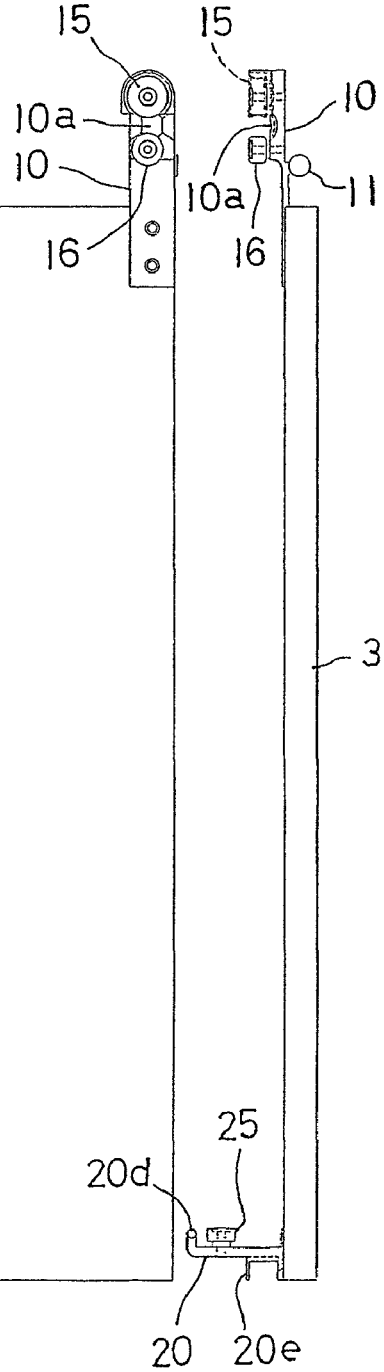

As shown in FIGS. 2 and 3, a support bracket 10 (runner support bracket) is mounted on left and right ends of an upper edge portion of the sliding door 3. A support bracket 20 (running portion support bracket) is mounted at the center of a lower edge portion of the sliding door 3. The support brackets 10, 20 will be described in details later.

Figure 4:
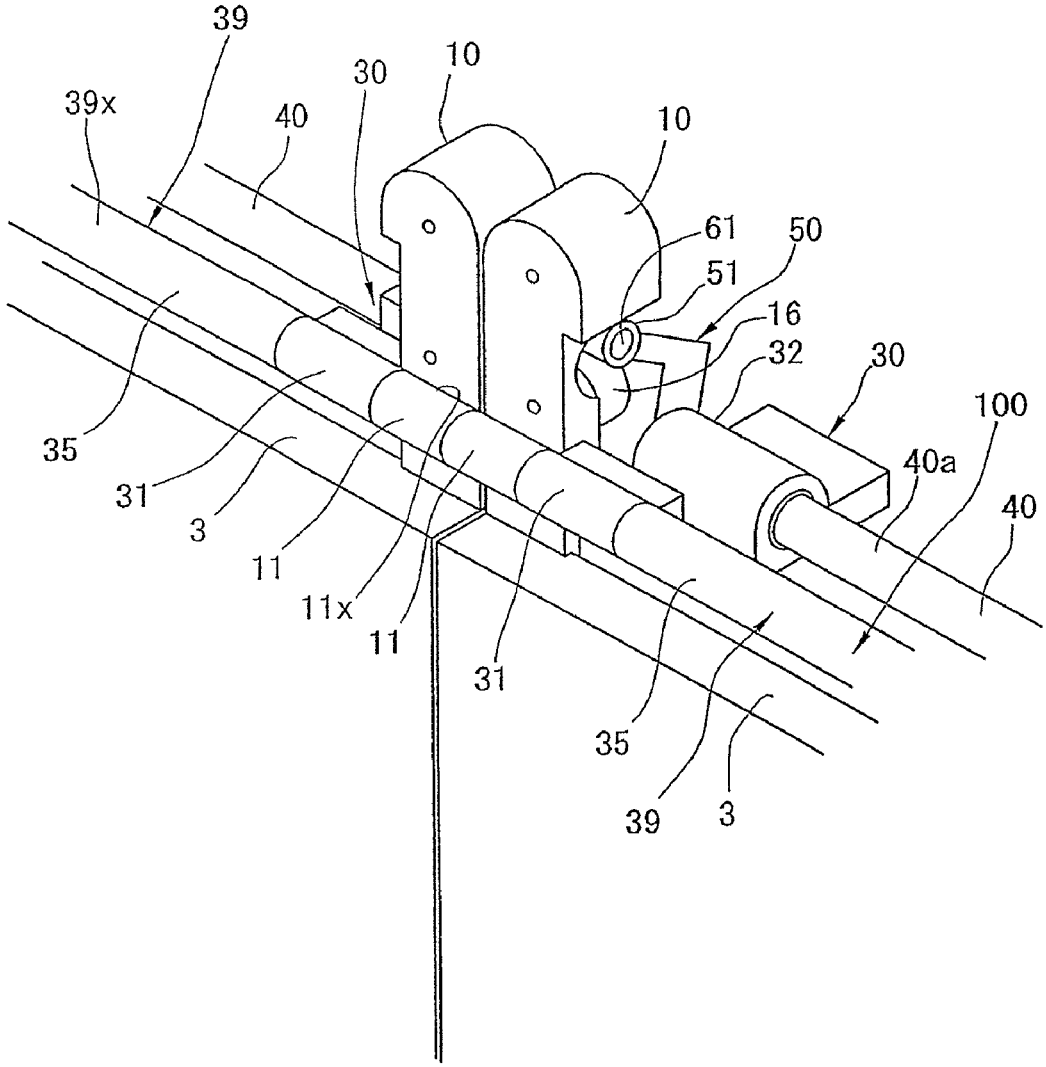
FIG. 4 is an enlarged perspective view of an upper structure of the guide apparatus.
Figure 5:
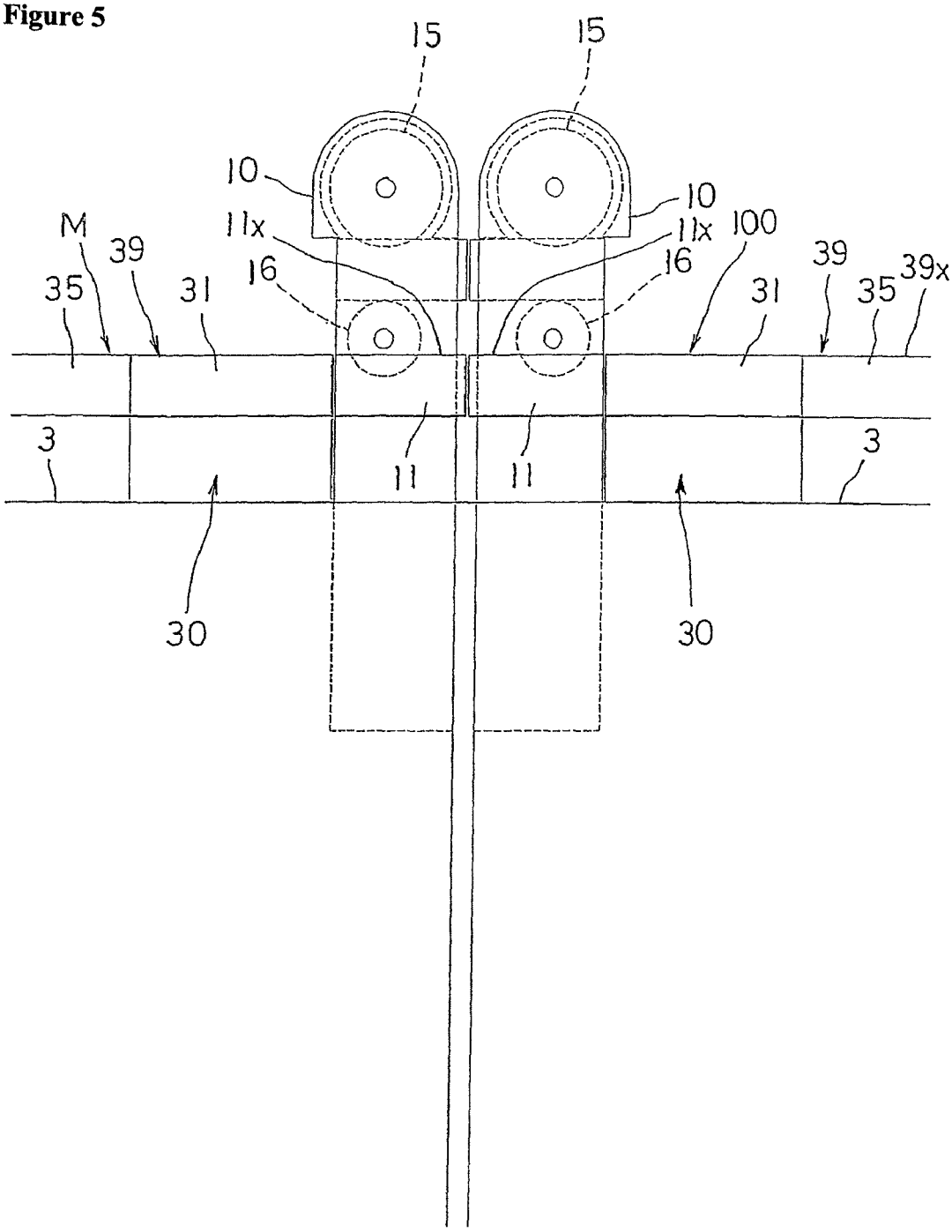
FIG. 5 is an enlarged front view of the upper structure of the guide apparatus when the sliding doors are in the closed position.
Figure 6:
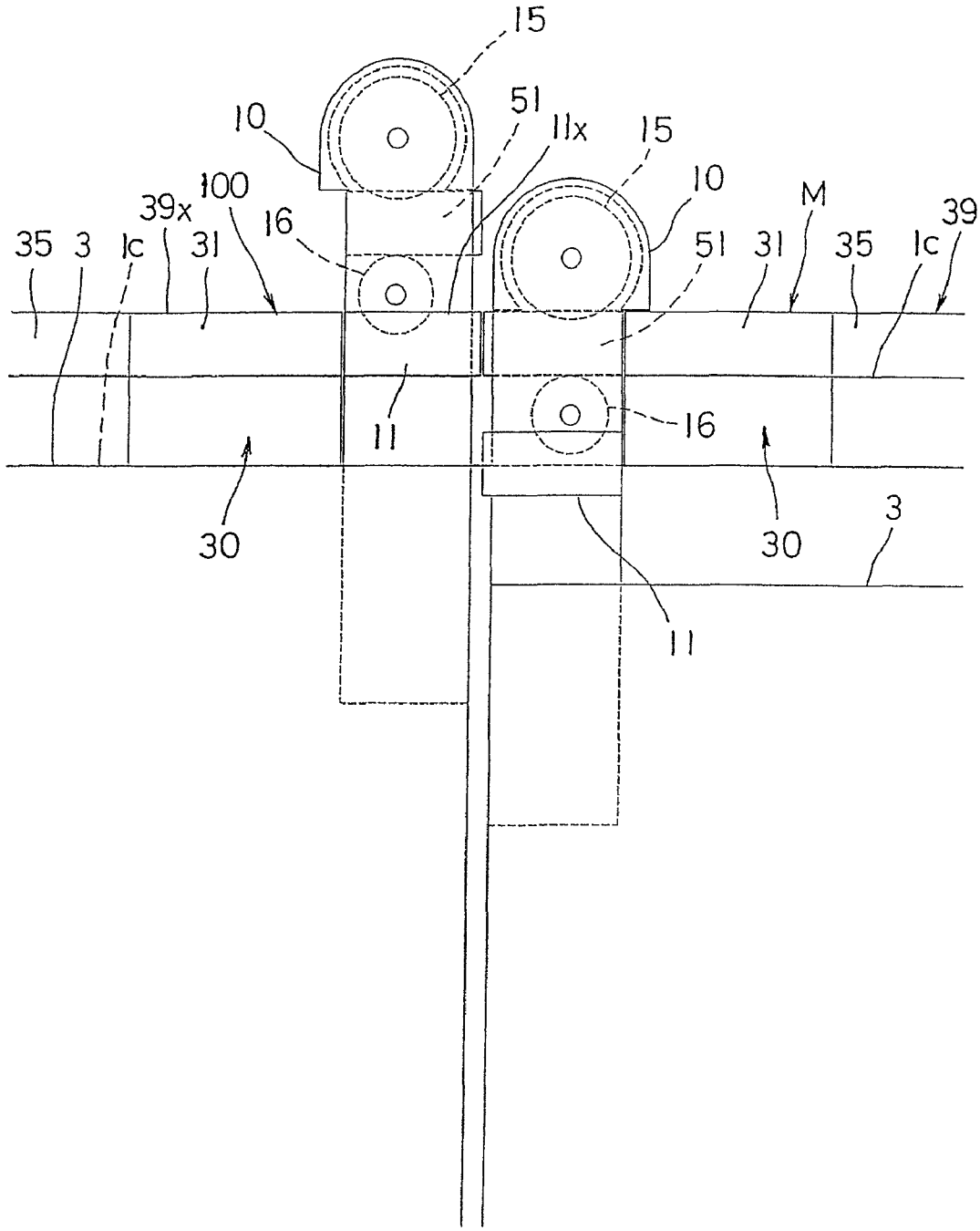
FIG. 6 is an enlarged front view of the upper structure of the guide apparatus when one of the sliding doors is in the opening preparation position.
Figure 8:
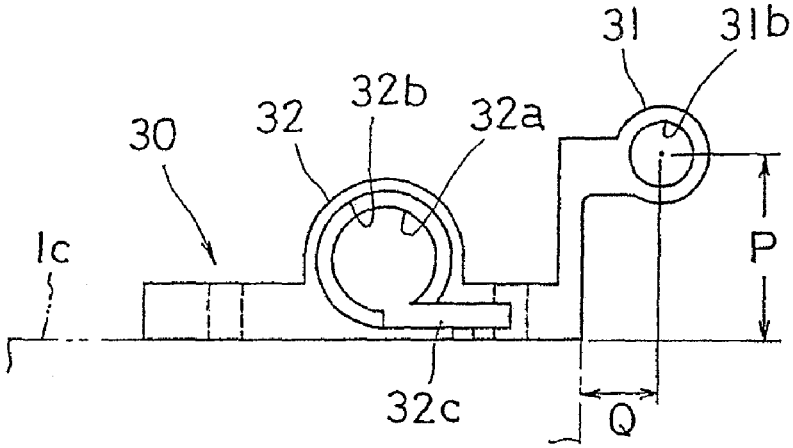
FIG. 8 is an enlarged side view of a support bracket mounted on a main body of the guide apparatus.

As shown in FIG. 1, a pair of right and left support brackets 30 is mounted on an upper surface of an upper frame portion 1*c* of the frame 1 (an upper edge portion of the opening) corresponding to each of the opening sections 2*x*. As shown in FIGS. 4 and 5, the support brackets 30 are located a predetermined distance inward from the left and right ends of the upper edge portion of the sliding door 3 in a closed condition. The support bracket 30 includes a column portion 31 extending horizontally along the upper frame portion 1*c*. As shown in FIG. 8, the column portion 31 is located above and in front of the upper frame portion 1*c*. The amount of projection of the center axis of the column portion 31 from the upper surface of the upper frame portion 1*c* is indicated with P and that of the same center axis from the front surface of the upper frame portion 1*c* is indicated with Q.

Figure 12:
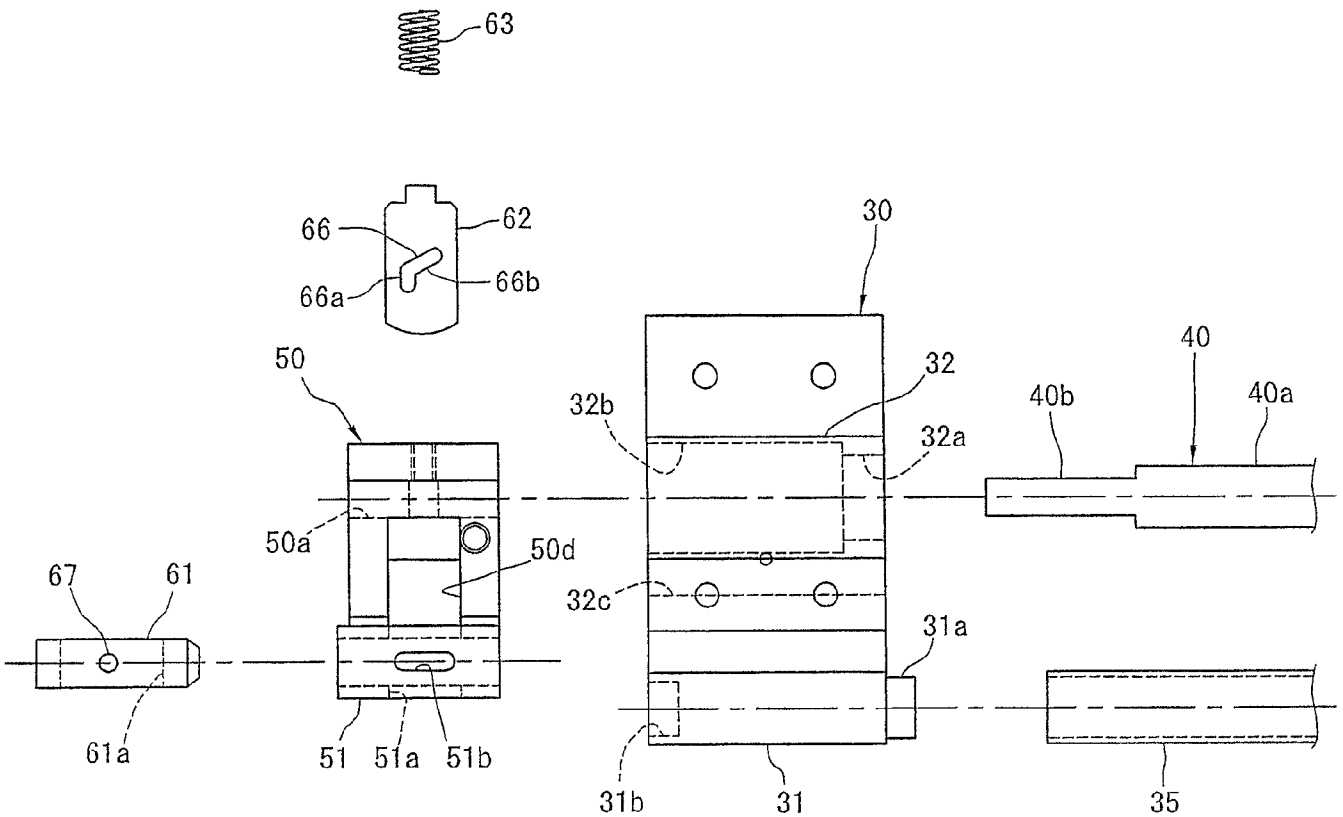
FIG. 12 is an enlarged exploded plan view of the holding mechanism showing individual components.

As shown in FIGS. 1 and 4, a pipe 35 is laid between the column portions 31 of each pair of the right and left support brackets 30 corresponding to each opening section 2*x*. As best shown in FIGS. 11 and 12, the outer diameter of the pipe 35 is the same as that of the column portion 31. The pipe 35 is supported at both ends, each fitted onto a protrusion 31*a* formed on an end surface of the column portion 31. The pair of right and left column portions 31 and the pipe 35 serve as a fixed linear rail 39 fixed on the frame 1 corresponding to each opening section 2*x*. An upper surface of the fixed rail 39 serves as a fixed track 39*x* (reference numeral 39*x* is shown only in FIGS. 4 and 5). Each fixed rail 39 runs along the full length, except for right and left end portions, of the upper edge portion of the opening section 2*x*. Four fixed rails 39 are arranged in a straight line.

As shown in FIGS. 4 and 12, an connecting shaft 40 is laid between the left and right support brackets 30 running parallel to and behind the pipe 35. More specifically, the support bracket 30 includes a cylindrical portion 32 behind the column portion 31. Inner space of the cylindrical portion 32 comprises a bearing hole 32*a* and a receiving hole 32*b* formed continuously in an axial direction. The interlock shaft 40 includes an elongated base portion 40*a* of circular cross-section and a connection portion 40*b* of non-circular cross-section extending coaxially from opposite ends of the base portion 40*a*. Each of opposite end portions of the base portion 40*a* of the interlock shaft 40 passes through the bearing hole 32*a* and the receiving hole 32*b* of the support bracket 30 and is rotatably supported by bearing in the bearing hole 32*a*.

As shown in FIGS. 4, 11 and 12, a rotatable link 50 (rotatable member) is disposed adjacent to the left and right support brackets 30. The left and right rotatable links 50 are arranged on the left and right end portions of the upper edge portion of the opening section 2*x*. The connection portions 40*b* on the left and right of the interlock shaft 40 protrude from the left and right support brackets 30. Onto the connection portion 40*b* an engagement hole 50*a* formed on a basal end portion of the rotatable link 50 is fitted (see FIG. 7). This arrangement allows the left and right rotatable links 50 to simultaneously rotate forward and backward via the interlock shaft 40. A rotation axis of the rotatable link 50 extends horizontally in parallel to the fixed rail 39.

Figure 9:
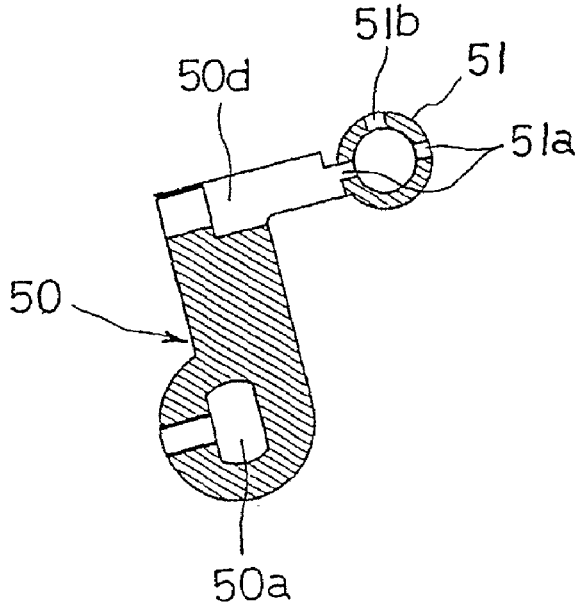
FIG. 9 is an enlarged vertical sectional view of a rotatable link of the guide apparatus.

As shown in FIGS. 4 and 9, the rotatable link 50 has an L-shaped vertical cross-section and has a cylindrical rail portion 51 integrally formed at an end thereof. The rail portion 51 is of the same outer diameter as, but shorter in length than the fixed rail 39. The rail portion 51 and the fixed rail 39 are parallel to each other. A circumferential surface of the rail portion 51 comprises an auxiliary track 51*x* and a supporting surface 51*y*, adjacent to each other in a circumferential direction (see FIG. 7).

The rail portion 51 moves between a first position right above the upper frame portion 1*c* of the frame 1 (shown in FIGS. 4 and 7(A)) and a second position located more forward and lower than the first position (shown in FIG. 7(B)) while the rotatable link 50 rotates between a first rotation position and a second rotation position. When the rail portion 51 is in the first position, the supporting surface 51*y* is at the top and when the rail portion is in the second position, the auxiliary track 51*x* is at the top and arranged in a straight line with the fixed track 39*x* of the fixed rail 39.

As shown in FIG. 7, the rotatable link 50 is biased to the rear by a torsion spring 55 (biasing member) received in the receiving hole 32*b* of the support bracket 30 so that the rotatable link 50 is maintained in the first rotation position. One end of the torsion spring 55 is caught in a catching groove 32*c* formed to be continuous with the receiving hole 32*b* of the support bracket 30 and the other end of the torsion spring 55 enters into a catching groove 50*c* formed in a side surface of the rotatable link 50. The catching groove 50*c* is arc-shaped. An adjustment screw 56 is screwed into the rotatable link 50 and a tip of the adjustment screw 56 is abutted with the other end of the torsion spring 55 so that biasing force of the torsion spring 55 is adjusted by the amount of screwing of the adjustment screw 56.

When the rotatable link 50 is in the second rotation position, it is prohibited from rotating by a holding mechanism 60 shown in FIGS. 11 and 12. The holding mechanism 60 is provided in the left rotatable link 50 corresponding to each opening section 2*x*. More specifically, a catching rod 61 is received in the cylindrical rail portion 51 of the rotatable link 50. The rotatable link 50 has a receiving recess 50*d* formed on an upper surface thereof. In the receiving recess 50*d* a plate-shaped slider 62 is received in such a manner that it can slide back and forth. A pressing spring 63 composed of a compression coil spring is received in the receiving recess 50*d* as well and biases the slider 62 to the front. The slider 62 passes through an elongated hole 51*a* formed in the rail portion 51 and an elongated hole 61*a* formed in the catching rod 61 and projects forward of the rail portion 51. A font edge of the slider 62 is arc-shaped and, as shown in FIG. 11(A), is to be engaged with a sphere-shaped engagement surface 10*a* formed in a rear surface of the support bracket 10 of the sliding door 3.

The catching rod 61 and the slider 62 are connected to each other by means of a cam mechanism 65. The cam mechanism 65 includes a cam hole 66 formed in the slider 62 and a follower pin 67 provided on the catching rod 61 and to be engaged with the cam hole 66. The cam hole 66 includes a first portion 66*a* extending in a front and rear direction and a second portion 66*b* extending obliquely backward from an rear end of the first portion 66*a*. The follower pin 67 is inserted into an elongated hole 51*b* formed in the rail portion 51 and extending in an axial direction of the rail portion 51. Owing to this arrangement, the catching rod 61 is allowed to move in an axial direction while prohibited from rotating.

Accompanying the movement of the slider 62, the catching rod 61 moves in the axial direction of the rail portion 51 and is engaged with or disengaged from the catching recess 31*b* formed on an end surface of the column portion 31 of the support bracket 30. The details will be described later.

On an undersurface of a lower frame portion 1*d* (lower edge portion of the opening section) of the frame 1, as shown in FIG. 1(C), a plurality of secondary rails 70 are mounted in a horizontal straight line along the lower frame portion 1*d*. The secondary rails 70 are separated by a gap 71 at the center of each opening section 2*x*. On each of end surfaces of the secondary rails 70 facing the gap 71, a guide plate 72 (guide member) is fixed. The secondary rail 70 includes a guide groove 70*a* (secondary track) opening at a bottom thereof as shown in FIG. 14(A). Both side surfaces of the guide groove 70*a* are vertical. As shown in FIGS. 13 and 14(B), the guide plate 72 includes a cutout 72*a* of the same shape as the guide groove 70*a* of the secondary rail 70. The cutout 72*a* is continuous with the guide groove 70*a*.

As shown in FIG. 14(B), a surface of the guide plate 72 facing the gap 71 serves as a guide surface 72*x* which is vertical and perpendicular to the secondary rail 70. The guide surface 72*x* has a straight groove 72*b* (guide groove) inclined downward to the front formed thereon. A lower end of the inclined groove 72*b* is continuous with a short cutout 72*c* extending vertically. The cutout 72*c* is open to a lower edge of the guide plate 72. The inclined groove 72*b* is not formed through is not formed through the guide plate 72 in the thickness direction in this embodiment, but it may be formed through the guide plate to form a slit.

The pair of support brackets 10 mounted on the left and right end portions of the upper edge portion of the sliding door 3 will now be described with reference to FIGS. 2 to 7. The support bracket 10 has a lower portion thereof fixed on the rear surface of the sliding door 3. The support bracket 10 has a rail member 11 integrally formed on a front surface of a center portion thereof. The rail member 11 is parallel to and of the same length as the rail portion 51. An upper surface of the rail member 11 serves as an additional track 11*x* (see FIGS. 4, 5 and 7). On a rear surface of an upper portion of the support bracket 10, rollers 15, 16 (runners) are rotatably supported at vertically separated locations. An outer circumference of the roller 15 includes a fitting groove 15*a* of arch-shaped cross section into which the rail portion 51 and the fixed rail 39 can be fitted. The support bracket 10 on the left when viewed from front has the engagement surface 10*a* mentioned earlier formed between the rollers 15 and 16 on the rear surface thereof. The support bracket 10 on the right does not include the engagement surface 10*a*.

The support bracket 20 mounted at the center of the lower edge portion of the sliding door 3 will now be described with reference to FIGS. 13, 14(C) and 15. The support bracket 20 includes a vertical, plate-shaped fixed portion 20*a* fixed on the rear surface of the sliding door 3, a horizontal portion 20*b* extending from a center of the fixed portion 20*a* backward in a horizontal direction, a rising position 20*c* rising from a rear end of the horizontal portion 20*b*, a pair of projections 20*d* projecting to the left and right from an upper end of the rising portion 20*c* and a rail portion 20*e*. The rail portion 20*e* has a guide groove 20*f* of the same shape as the guide groove 70*a* of the secondary rail 70 formed therein.

On an upper surface of the horizontal portion 20*b* of the support bracket 20, a roller 25 (running portion) having a vertical rotation axis is rotatably mounted. The support bracket 20 and the roller 25 constitutes a secondary runner 29.

Operation of an opening and closing apparatus as constructed above will now be described. First, the apparatus in the condition that all of the four opening sections 2*x* are closed by the sliding doors 3 as shown in FIG. 1(A) will be described. The upper and lower edge portions of the sliding door 3 abut with the upper frame portion 1*c* and the lower frame portion 1*d* respectively of the frame 1 or are in the vicinity of them separated by a slight gap. Front surfaces of all the sliding doors 3 arranged side by side are located in a single vertical plane, being flush with each other.

When the sliding door 3 is in the closed position, the upper roller 15 of the support bracket 10 rides on the support surface 51*y* of the rail portion 51 of the rotatable link 50, whereby the sliding door 3 is suspendedly supported by the pair of rotatable links 50. The lower roller 16 abuts with an undersurface of the rail portion 51 or is opposed to it separated by a slight gap.

The rotatable link 50 is biased to the rear by a biasing force of the torsion spring 55, whereby, as shown in FIGS. 2(A) and 7(A), the rail portion 51 of the rotatable link 50 is maintained at the first position above the upper frame portion 1*c* of the frame 1. Backward rotation of the rotatable link 50 is prohibited by a stopper (not shown) mounted on the upper frame portion 1*c* behind the rotatable link 50. Alternatively, the backward rotation of the rotatable link 50 may be prohibited by abutment of the sliding door 3 against the frame 1.

When all the sliding doors 3 are closed, as shown in FIG. 1(A), the rail member 11 of the support bracket 10 is arranged in a straight line with the fixed rail 39 fixed on the frame 1. The additional tracks 11*x* of the plurality of the rail members 11 and the fixed tracks 39*x* of the plurality of the fixed rails 39 constitute a straight continuous track M (see FIG. 5).

When the sliding door 3 is in the closed position, the support bracket 20 mounted at the center of the lower edge portion of the sliding door 3 is received between a pair of the guide plates 72. The right and left projections 20*d* of the support bracket 20 are located near upper ends of the inclined grooves 72*b* of the left and right guide plates 72 facing each other across the gap 71, thereby prohibiting the lower edge of the sliding door from swinging back and forth. The guide groove 20*f* of the rail portion 20*e* of the support bracket 20 is continuous with the cutout 72*a* of the guide plate 72, and the guide groove 20*f* is continuous with the guide groove 70*a* of the secondary rail 70 via the cutout 72*a*.

Opening movement of the sliding door 3 will now be described taking the sliding door 3 second from the left as an example. As shown in FIGS. 1(B), 2(B), 6 and 7(B), the pulls 3*a* are grabbed and the sliding door 3 is pulled out to the opening preparation position located in the front. When the sliding door 3 is being pulled out, the rotatable link 50 is rotated forward against the biasing force of the torsion spring 55 through engagement between the roller 15 of the sliding door 3 and the rail portion 51 of the rotatable link 50. This makes the rail member 11 of the sliding door 3 comes away from the fixed rail 39. Instead, the rail portion 51 of the rotatable link 50 reaches the second position to form a straight line with the fixed rail 39. Accompanying rotation of the rotatable link 50 from the first rotation position to the second rotation position, the auxiliary track 51*x* replaces the supporting surface 51*y* at the top of the rail portion 51 and supports the roller 15.

When one of the sliding doors 3 is in the opening preparation position, the continuous track M arranged in one straight line, is composed of the fixed tracks 39*x* of the four fixed rails 39, the auxiliary tracks 51*x* of the two rail portions 51 supporting the sliding door 3 in the opening preparation position and the additional tracks 11*x* of the rail members 11 of the remaining three sliding doors 3. The rotatable link 50 is prohibited from rotating further forward by a stopper (not shown) mounted on the upper frame portion 1*c* in front of the rotation link 50.

When the sliding door 3 moves from the closed position to the opening preparation position, being supported by the rotatable link 50, it is displaced downward. As the sliding door 3 makes this movement, the support bracket 20 is guided along the guide surfaces 72*x* of the pair of the guide plates 72 and the pair of the left and right projections 20*d* of the support brackets 20 moves diagonally forward along the inclined grooves 72*b* of the left and right guide plates up to the cutouts 72*c*. In this way, the sliding door 3 can move to the opening preparation position with the lower edge portion thereof moving in the stable manner. When the sliding door 3 reaches the opening preparation position and the projections 20*d* of the support brackets 20 are engaged in the cutouts 72*c*, the roller 25 of the support bracket 20 is located in a position corresponding to the cutout 72*a* and the rail portion 20*e* of the support bracket 20 comes away from the secondary rail 70.

From the opening preparation position, the sliding door 3 is moved to an open position in the left or right. As the sliding door 3 makes this movement, the roller 15 of the support bracket 10 comes away from the auxiliary track 51*x* of the rail portion 51 of the rotatable link 50. As shown in FIG. 1(C), when the sliding door 3 is moved to the right, the roller 15 of the support bracket 10 on the right transfers onto the additional track 11*x* of the rail member 11 of the support bracket 10 of the sliding door 3 adjacent on the right, then onto the fixed track 39*x* of the fixed rail 39. The roller 15 of the support bracket 10 on the left transfers from the auxiliary track 51*x* of the rail portion 51 onto the fixed track 39*x* of the fixed rail 39 adjacent on the right. As is clear from this, the fixed track 39*x* and the additional track 11*x* of the sliding door 3 in the closed condition constitutes a main track 100 for the sliding door 3 moving to the open position. The fixed rail 39 and the rail member 11 of the sliding door 3 in the closed position constitute a main rail including the main track 100.

The open position of the sliding door 3 in this specification refers to any position of the sliding door 3 between when the opening section 2*x* is partially opened and when the sliding door 3 is entirely overlapped with one of the other sliding doors at the left or right end.

When the sliding door 3 moves from the opening preparation position to the open position to the left or right, the rail portion 51 of the rotatable link 50 stays in a straight line with the fixed rail 39.

More specifically, when the sliding door 3 is in the closed position and the rollers 15 of the left and right support brackets 10 are engaged with the rail portions 51 of the left and right rotatable links 50, a front edge of the slider 62 of the holding mechanism 60 disposed on the rotatable link 50 on the left is, as shown in FIG. 11(A), abutted with the engagement surface 10*a* of the support bracket 10 under the biasing force of the compression coil spring 63. At this time, the follower pin 67 of the catching rod 61 is located at a crossing of the first portion 66*a* and the second portion 66*b* of the cam hole 66 of the slider 62 and the catching rod 61 is in a backward positon where an end surface thereof is generally flush with an end surface of the rail portion 51.

Even when the sliding door 3 moves to the opening preparation position, the holding mechanism 60 is maintained in the above mentioned condition. When the sliding door 3 moves either to the left or right from the opening preparation position, as shown in FIG. 11(B), either a left or right edge portion of the engagement surface 10*a* of the support bracket 10 temporarily depresses the slider 62 and the follower pin 67 temporarily reaches a front end of the first position 66*a* of the cam hole 66 of the slider 62. When the sliding door 3 moves further, as shown in FIG. 11(C), the slider 62 is released from a pressure of the engagement surface 10*a* of the support bracket 10 and projects forward. At the same time, the follower pin 67 moves relative to the slider 62 along the first portion 66*a* and the second portion 66*b* to a rear end of the second portion 66*b*. During that time, the catching rod 61 projects from the end surface of the rail portion 51 to be fitted into the catching recess 31*b* of the column portion 31 of the support bracket 30. As a result, the rail portion 51 of the left rotatable link 50 is held coaxial with the fixed rail 39. Since the right rotatable link 50 is connected with the left rotatable link 50 via the interlock shaft 40, the rail portion 51 of the right rotatable link 50 is held coaxial with the fixed rail 39 as well.

As a result, even if one of the sliding doors 3 moves to the open position, the auxiliary track 51*x* of the rotatable link 50 corresponding to that sliding door 3 remains as a part of the continuous track M, and the sliding door 3 can move freely from one end to the other of the continuous tack M. A load of the sliding door 3 is supported by a portion of the continuous track M where the roller 15 rides on.

When the sliding door 3 moves from the opening preparation position to the open position to the left or right, the roller 25 of the support bracket 20 in a lower portion of the sliding door 3 enters the guide groove 70*a* of the secondary rail 70 via the cutout 72*a* of the guide plate 72 and runs along the guide groove 70*a*. When the sliding door 3 is in the opening preparation position and in the open position, the support bracket 20 is released from restriction of the guide plate 72. The roller 25 of the support bracket 20 moves freely along the rail portions 20*e* of the support brackets 20 of other sliding doors 3 and the cutouts 72*a* of the guide plates 72 and the secondary rails 70.

The sliding door 3 in the open position can be returned to the opening preparation position, and then pushed back to the closed position. Since the rail portion 51 of the rotatable link 50 is held and maintained coaxial with the fixed rail 39 as mentioned earlier, the roller 15 of the sliding door 3 can ride on the rail portion when the sliding door 3 moves back to the opening preparation position. When the sliding door 3 reaches the opening preparation position, the distal edge of the slider 62 of the holding mechanism 60 is pushed by the support bracket 10 to be fitted into the engagement surface 10*a*, thereby positioning the sliding door 3 and releasing the rotatable link 50 from a locked condition by the holding mechanism 60.

In a case where more than three sliding doors 3 are provided as in this embodiment, when one of the sliding doors 3 is in the open position, one of the other sliding doors 3 can move from the closed position to the opening preparation position, then from the opening preparation position to the open position in the same manner. Therefore, the positions of two of the sliding doors 3 can be changed.

According to this embodiment, partitions of a variety of length can be easily made by using a desired number of the sliding doors 3, each of the sliding doors 3 accompanying various components, i.e. the support brackets 10, 20, the rotatable link 50, the support bracket 30, and the pipe 35 as one set. Short secondary rails 70 located on the left and right end of the partition and the guide plates 72 fixed on these short secondary rails 70 may be omitted. In such a case, the sliding doors 3 on both ends are guided by a single guide plate 72 while moving from the closed position to the opening preparation position.

Other embodiments of the present invention will now be described. Same reference numerals are used to designate the same or corresponding elements as in the preceding embodiments and detailed explanations are omitted for such elements.

Figure 16:
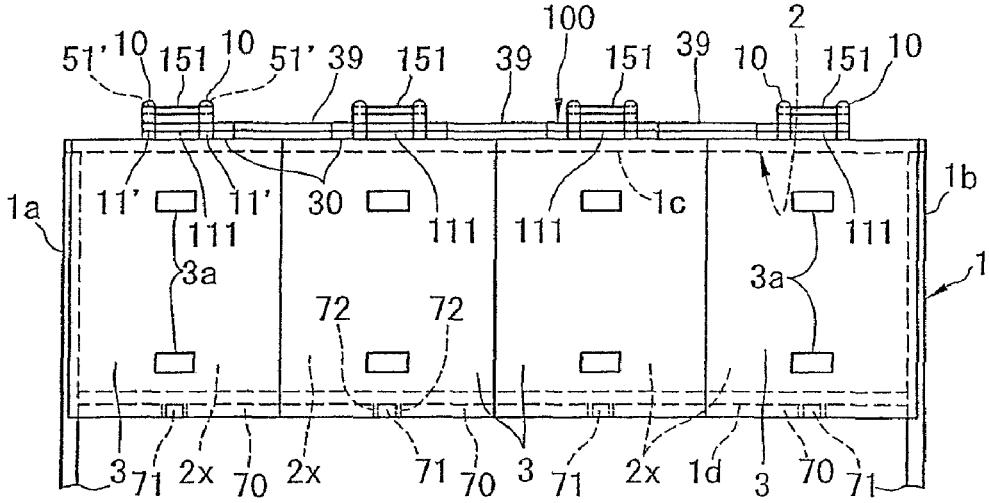
FIG. 16 is a front view of a second embodiment of the present invention.

In a second embodiment as shown in FIG. 16, the fixed rail 39 is mounted not in a middle portion of the upper edge portion of each opening section 2*x*, but over two adjacent opening sections 2*x*. The pair of support brackets 10 of each sliding door 3 is mounted not at the left and right end portions but at locations nearer to the center of the sliding door 3. Left and right rotatable links of a similar shape to those of the first embodiment are mounted at locations corresponding to the support brackets 10. Rail portions 51' (corresponding to the rail portions 51 of the first embodiment) of the left and right rotatable links and a pipe 151 connected between the rail portions 51' constitute a long auxiliary track. Rail members 11' (corresponding to the rail members 11 of the first embodiment) of the left and right support brackets 10 and a pipe 111 connected between the rail members 11' constitute a long additional track. Except for the above mentioned features, the second embodiment is of the same construction as the first embodiment. The number of the fixed rails 39 is smaller in the second embodiment than in the first embodiment.

Figure 17:
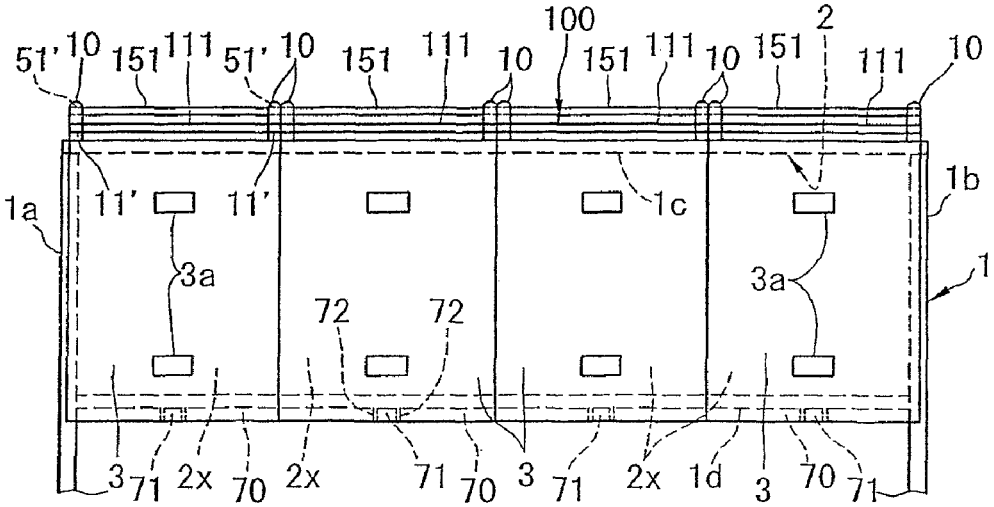
FIG. 17 is a front view of a third embodiment of the present invention.

In a third embodiment as shown in FIG. 17, the fixed rail 39 used in the first and the second embodiments is not used. Instead, an auxiliary track composed of the rail portion 51' and the pipe 151 and an additional track composed of the rail portion 11' and the pipe 111 are generally of the same length as a width of the sliding door 3. In this embodiment, when one of the sliding doors moves, a main track for the moving sliding door is composed only of the additional tracks of the sliding doors in the closed condition.

Figure 18:
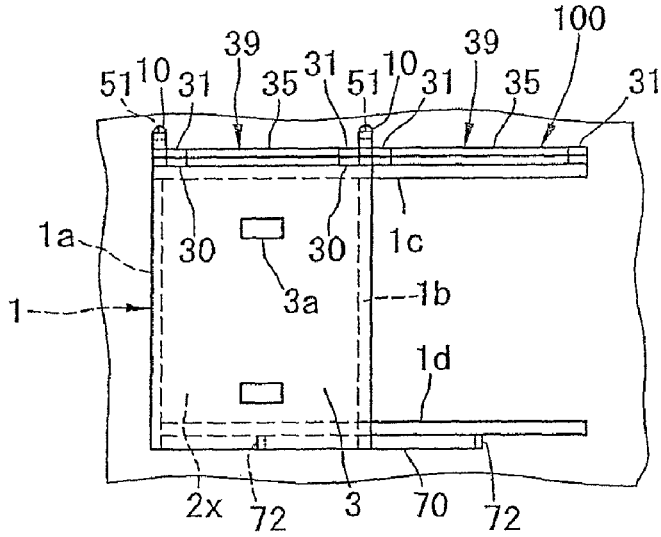
FIG. 18 is a front view of a fourth embodiment of the present invention.

In a fourth embodiment as shown in FIG. 18, there is provided an opening and closing apparatus comprising one sliding door which may be applicable to a window of a house. Its basic structure is similar to that of the first embodiment. The upper and lower frame portions 1*c* and 1*d* of the frame 1 surrounding the opening section 2*x*, i.e. the window, extend either to the left or right of the opening section 2*x*. The fixed rail 39 is arranged immediately above a part of the upper frame portion 1*c* defining the opening section 2*x* as in the first embodiment. A pair of rotatable links is mounted adjacent to the left and right ends of the fixed rail 39. Above a part of the upper frame portion 1*c* extending from the opening section 2*x*, another fixed rail 39 is mounted.

On the lower frame portion 1*d*, the secondary rail 70 extending from a middle of the opening section 2*x* to a middle of an extended portion of the lower frame portion 1*d* is fixed. On both ends of the secondary rail 70, the guide plate 72 is fixed. The sliding door 3 and other elements mounted on the sliding door 3 are the same as those of the first embodiment, except that the additional track is not formed. In this embodiment too, the sliding door 3 moves in a front and rear direction when it moves between the closed position and the opening preparation position. By making the frame 1 closely contact the sliding door 3, airtightness of a house can be enhanced. A sliding door may be received in a door case in the open position and the sliding door may be flush with the door case in the closed position.

Figure 19:
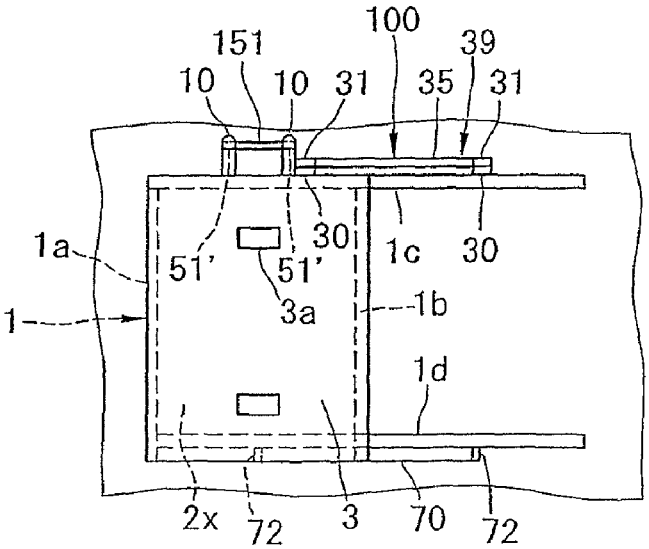
FIG. 19 is a front view of a fifth embodiment of the present invention.

In a fifth embodiment as shown in FIG. 19, there is also provided an opening and closing apparatus comprising one sliding door which may be applicable to a window of a house. Basic structure of this embodiment is similar to that of the second embodiment as shown in FIG. 16.

In all of the embodiments mentioned above, the load of the sliding door 3 is supported by the rotatable link 50 and the fixed rail 39 mounted on the upper frame portion 1*c*, the sliding door 3 being suspendedly supported by them. Therefore, elements in the lower edge portion of the sliding door 3, such as the support bracket 20 and the secondary rail 70, may be omitted.

In a sixth embodiment as shown in FIG. 20, the support brackets 10, 20 mounted on the sliding door 3 and the elements supporting the sliding door 3 are arranged upside down compared to the first embodiment. In this embodiment, the load of the sliding door 3 is supported by the roller 16 of the support bracket 10 fixed on a lower edge portion of the sliding door 3, the roller 16 riding on the rail portion 51 of the rotatable link 50 or the fixed rail 39. The roller 16 is provided with a fitting groove in a circumferential surface thereof, in which the rail portion 51 is to be fitted. The sliding door 3 moves upward when it moves from the closed position to the opening preparation position. Except for the above-mentioned features, the sixth embodiment is of the same construction and operation as the first embodiment, and therefore the explanation thereof will be omitted.

In the second to fifth embodiments shown in FIGS. 16 to 19, elements may be arranged upside down.

Figure 21:
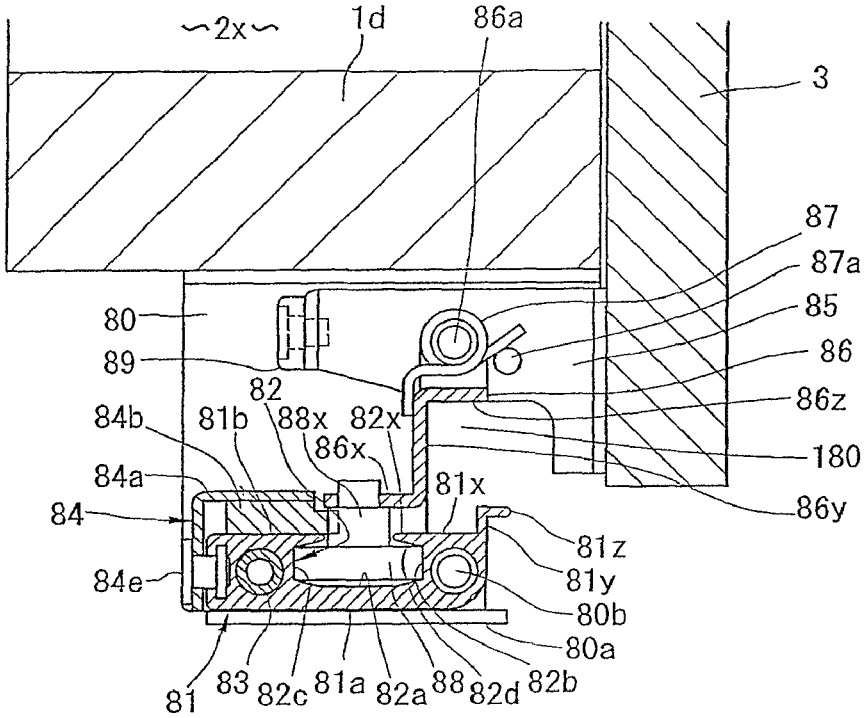
FIG. 21 is a vertical sectional view of a lower structure of a guide apparatus according to a seventh embodiment of the present invention when the sliding door is in the closed position.
Figure 22:
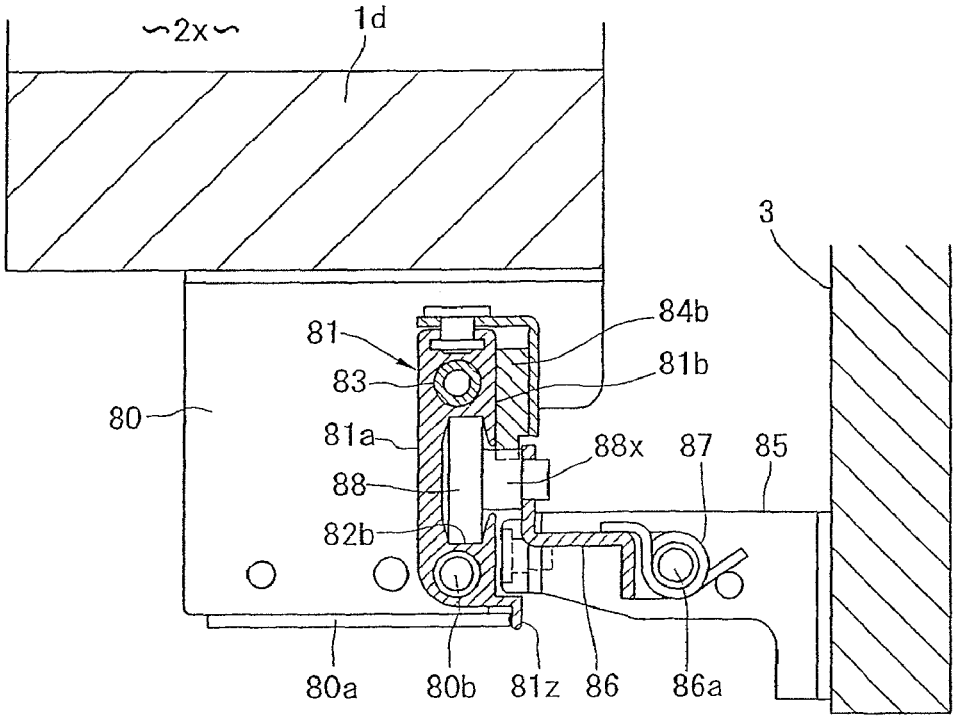
FIG. 22 is a vertical sectional view of the lower structure of the guide apparatus according to the seventh embodiment when the sliding door is in the opening preparation position.
Figure 23:
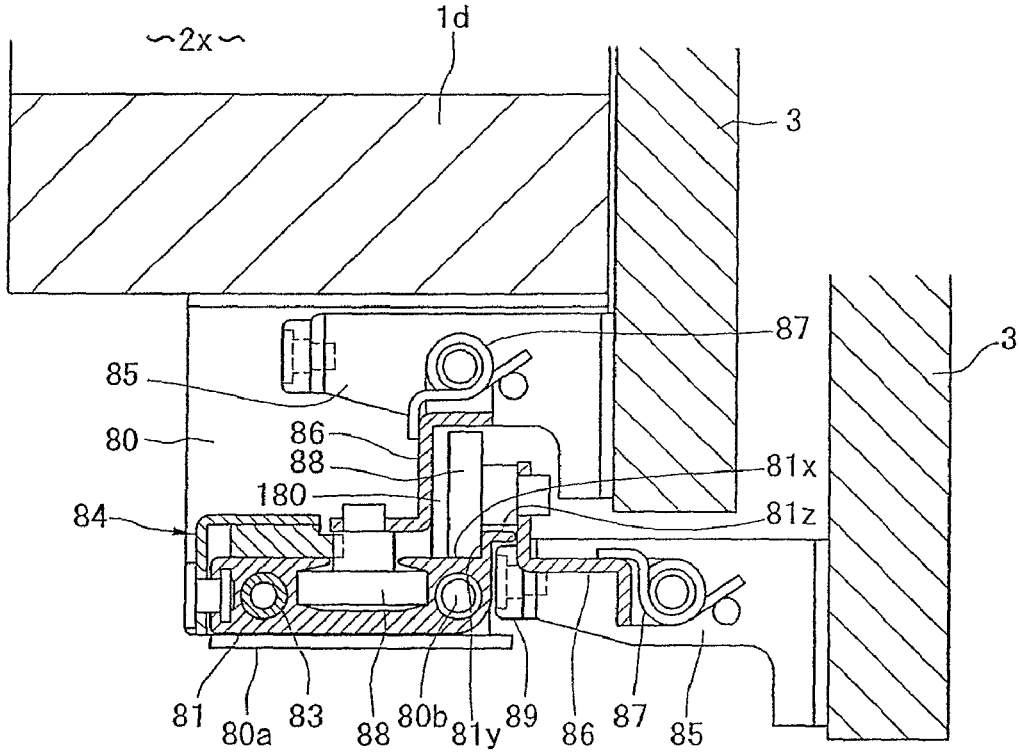
FIG. 23 is a vertical sectional view of the lower structure of the guide apparatus according to the seventh embodiment when the sliding door is in the open position overlapped with one of the other sliding doors in the closed position.

A seventh embodiment of the present invention will now be described with reference to FIGS. 21 to 30. Lower structure of a sliding door guide apparatus will first be described with reference to FIGS. 21 to 25. As shown in FIGS. 21 to 23, on an undersurface of the lower frame portion 1*d*, for each opening section 2*x*, a pair of left and right support brackets 80 (only one of the pair is shown) are fixed separated by almost the entire width of the opening section 2*x*. The support bracket 80 includes a load receiving portion 80*a* extending horizontally from a lower edge. The support brackets 80 of adjacent opening sections 2*x* are abutted back to back with each other.

Between front lower end portions of the pair of support brackets 80, a rotatable rail 81 (rotatable member) made of an extruded material is rotatably supported via rotation shafts 80*b* extending horizontally to the left and right. The rotatable rail 81 is of a wide elongated plate and includes two flat surfaces 81*a*, 81*b* which are parallel to each other. The length of the rotatable rail 81 is generally same as the width of the opening section 2*x*, in other words the width of the sliding door 3. The rotatable rail 81 is rotatable within an angle range of around 90 degrees between a horizontal down position (first rotation position) in the rear and a standing position (second rotation position) in the front. The rotatable rail 81 is held at the horizontal down position by riding on the load receiving portion 80*a* of the support bracket 80 with the flat surface 81*a* abutting the upper surface of the load receiving portion 80*a*.

The other flat surface 81*b* of the rotatable rail 81 has a receiving groove 82 formed at a center in a width direction thereof. The receiving groove 82 has an opening in an upper side thereof when the rotatable rail 81 is in the horizontal down position. A pair of overhangs 82*x* facing each other is formed at an opening edge of the receiving groove 82. The receiving groove 82 includes a wide bottom first surface 82*a*, a narrow second surface 82*b* and a narrow third surface 83*c* located at the opposite sides of the bottom surface 82*a*, and a fourth surface 82*d* on the inner side of the overhand 82*x*. In this embodiment, the first surface 82*a* serves as a supporting surface and the second surface 82*b* which is nearer to a rotation center serves as an auxiliary track. In the flat surface 81*b* of the rotatable rail 81, a surface portion near the rotation shaft 80*b* serves as an additional track 81*x*.

In an edge portion of the rotatable rail 81 on the rotation shaft 80*b* side, the rotatable rail 81 has a restriction wall 81*y* projecting from the additional track 81 and an engaging portion 81*z* projecting perpendicular to the restriction wall 81*y* in the opposite direction of the additional track 81*x*. As shown in FIG. 22, when the rotatable rail 81 is in the standing position, the rotatable rail 81 is prevented from falling in the front by abutment of the engaging portion 81*z* with a front edge of the load receiving portion 80*a*.

Figure 24:
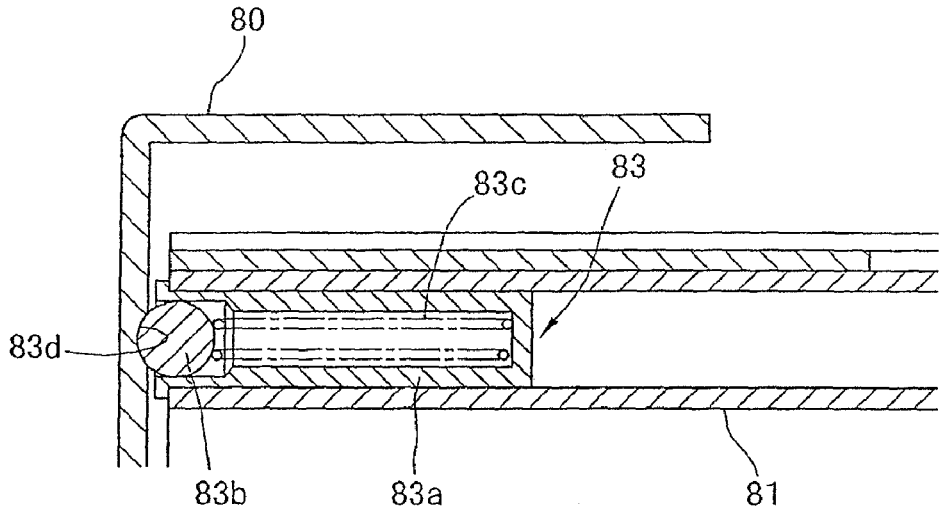
FIG. 24 is a horizontal sectional view of a holding mechanism of a rotatable rail used in the seventh embodiment.

When the rotatable rail 81 is in the standing position, it is prevented from falling in the rear by a holding mechanism 83 shown in FIG. 24. The holding mechanism 83 is disposed near a free edge portion of the rotatable rail 81 in one end side in a longitudinal direction of the rotatable rail 81. The holding mechanism 83 includes a holder case 83*a* fitted into the end of the rotatable rail 81, a ball 83*b* disposed at an opening end of the holder case 83*a*, a coil spring 83*c* received in the holder case 83*a* and pushes the ball 83*b* toward a side wall of the support bracket 80 and a sphere-shaped recess 83*d* formed in the side wall of the support bracket 80. When the rotatable rail 81 is in the standing position, the ball 83*b* fits into the recess 83*d*, thereby maintaining the rotatable rail 81 in the standing position.

Figure 25:
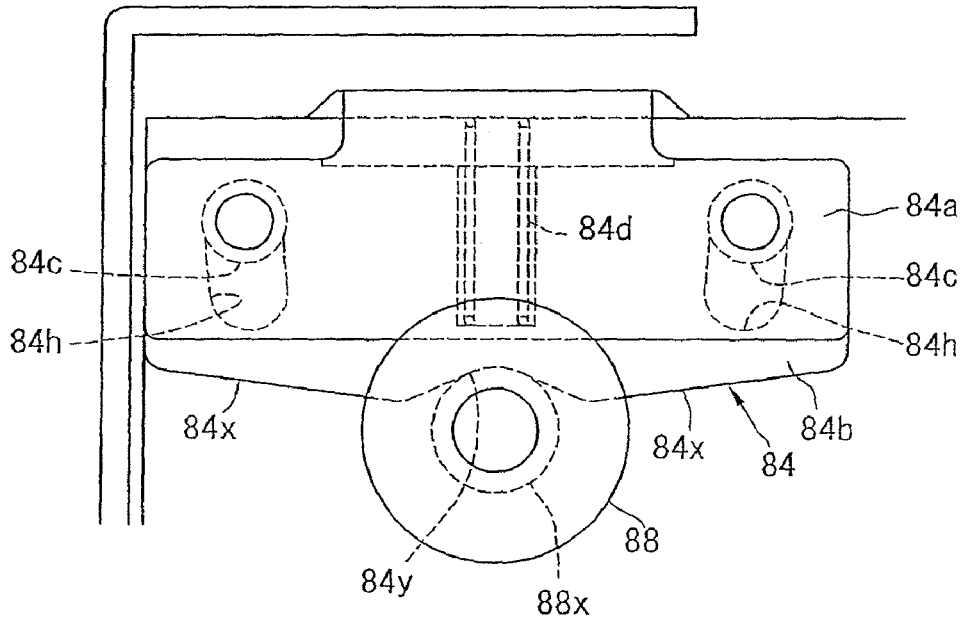
FIG. 25 is a front view of a positioning mechanism used in the seventh embodiment.

The rotatable rail 81 is further provided with a positioning mechanism 84 shown in FIGS. 21 and 25. The positioning mechanism 84 positions the sliding door 3 while it moves from the open position to the opening preparation position. The positioning mechanism 84 includes a holder 84*a* of an L-shaped cross-section and a movable member 84*b*. A first part of the holder 84*a* is fixed to the free edge portion of the rotatable rail 81 with a fixing member 84*e*. Between a second part of the holder 84*a* and the flat surface 81*b* of the rotatable rail 81, the movable member 84*b* is arranged. On the second part of the holder 84*a*, a pair of left and right pins 84*c* is fixed.

The movable member 84*b* includes a pair of elongate holes 84*h* in the left and right. Each elongate hole 84*h* is of a shape of an arc which is a section of a circle centered at an end of the other elongate hole 84*h* (an upper end of the other elongate hole 84*h* when the rotatable rail 81 is in the standing position as shown in FIG. 22). The pins 84*c* are inserted in the elongate holes 84*h*. Owing to this arrangement, the movable member 84*b* is allowed to swing and to move vertically. The movable member 84*b* includes a hole in a surface thereof facing the first part of the holder 84*a*. The hole receives a coil spring 84*d* therein. The coil spring 84*d* biases the movable member 84*b* toward a direction away from the first part of the holder 84*a*. On a side opposite to a direction of the first part of the holder 84*a*, the movable member 84*b* includes an inclined guiding surface 84*x* in the left and right and an arc-shaped engagement surface 84*y* in the middle. Operation of the positioning mechanism 84 will be described later.

On a rear surface of the lower edge portion of the sliding door 3, a pair of left and right support brackets 85 are mounted. At a rear end of the support brackets 85, an auxiliary roller 89 is rotatably supported. Between the pair of support brackets 85, a long support bracket 86 (runner support bracket) having a generally Z-shaped cross-section is connected with basal end portion thereof rotatably connected via a rotation shaft 86*a*. A rotation axis of the support bracket 86 runs parallel to a rotation axis of the rotatable rail 81 and extends horizontally to the left and right. The support bracket 86 includes a first part 86*x* in a distal end side and a second part 86*y* in the middle, which are orthogonal to each other, and a third part 86*z* in a basal end side being parallel to the first part 86*x*. The support bracket 86 is biased counter-clockwise by a torsion spring 87 (biasing member). The torsion spring 87 is coiled around the rotation shaft 86*a* with one end thereof being hooked to a pin 87*a* fixed to the support bracket 85 and the other end being hooked to the second part 86*y* of the support bracket 86.

On the first part 86*x* of the support bracket 86, a disc-shaped roller 88 (runner) is turnably supported via a support shaft 88*x* orthogonal to the first part 86*x*. The roller 88 is received in the receiving groove 82 of the rotatable rail 81.

Upper structure of the guide apparatus according to the seventh embodiment will now be described with reference to FIGS. 26 to 30. Detailed description will be omitted here since the upper structure of the seventh embodiment is similar to the lower structure of the first embodiment and the upper structure of the sixth embodiment. A support bracket 120 (running portion support bracket) is fixed to a rear surface of the right end of an upper edge portion in the sliding door 3. The support bracket 120 includes a vertical fixed portion 120*a* fixed on the rear surface of the sliding door 3 and projecting upward, a horizontal portion 120*b* projecting horizontally backward from an upper end of the fixed portion 120*a*, a standing portion 120*c* standing from an rear end of the horizontal portion 120*b* and a pair of projections 120*d* projecting to the left and right from the upper end of the standing portion 120*c*. On a front surface of the fixed portion 120*a* of the support bracket 120, a rail portion 120*e* constituting a part of the support bracket 120 is fixed. The rail portion 120*e* has a guide groove 120*f* formed therein. The guide groove 120*f* has a narrow space 120*g* formed at an upper portion thereof.

On an upper surface of the horizontal portion 120*b* of the support bracket 120, a roller 125 (runner) having a vertical rotation axis is turnably mounted. The support bracket 120 and the roller 125 constitute a secondary runner 129.

Figure 27:
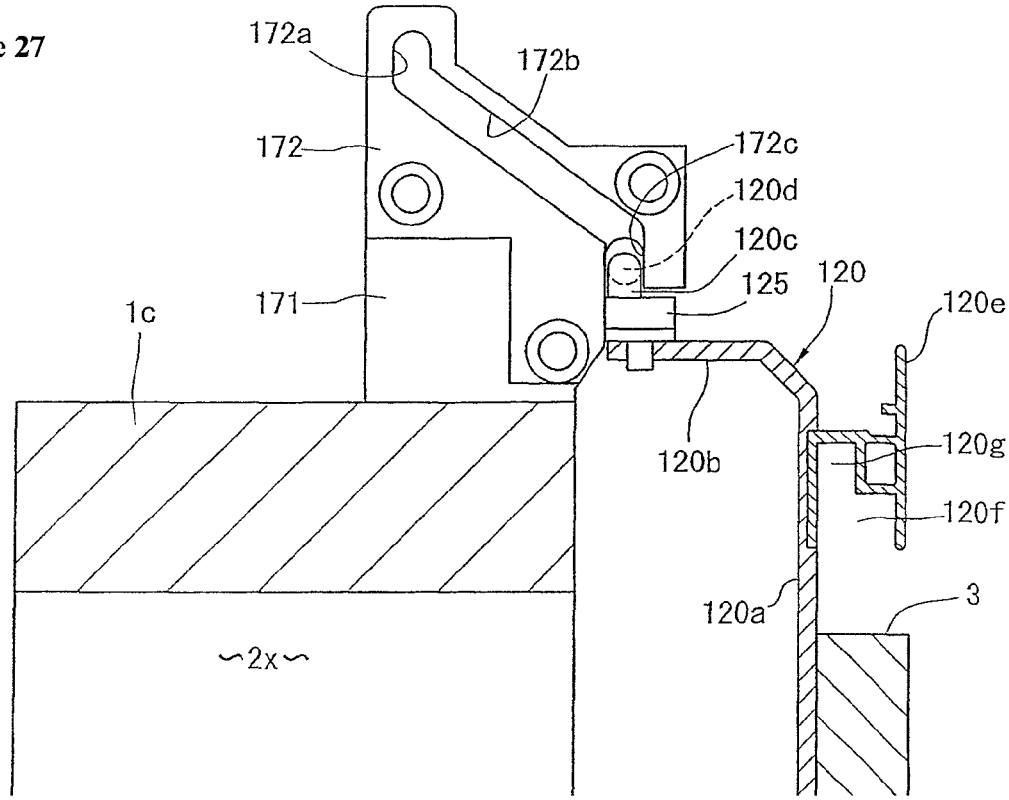
FIG. 27 is a vertical sectional view of the upper structure of the guide apparatus according to the seventh embodiment when the sliding door is in the opening preparation position.

A pair of support brackets 171 are fixed on the upper surface of the upper frame portion 1*c* of the frame 1 and located at a right end of each opening section 2*x*. A guide plate 172 (guide member) is fixed on each of opposing surfaces of the support brackets 171 opposing each other. As best shown in FIG. 27, the guide plate 172 has a straight inclined groove 172*b* (guide groove) inclined downward to the front formed on an opposing surface (guide surface) thereof. An upper end of the inclined groove 172*b* is continuous with a short vertical groove 172*a* extending upward, and a lower end of the inclined groove 172*a* is continuous with a short cutout 172*c* extending vertically. The cutout 172*c* opens to the lower edge of the guide plate 172.

Figure 28:
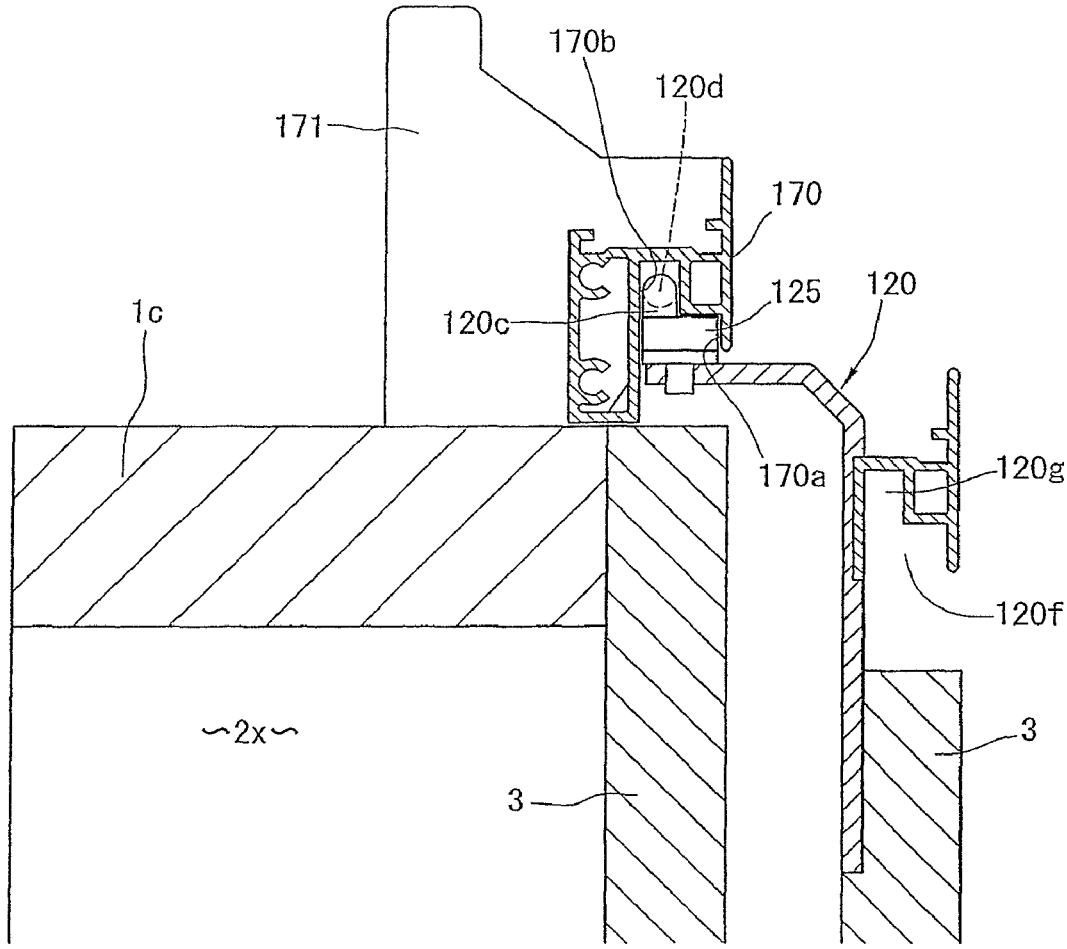
FIG. 28 is a vertical sectional view of the upper structure of the guide apparatus according to the seventh embodiment when the sliding door is in the open position overlapped with one of the other sliding doors in the closed position.

For each opening section 2*x*, a secondary rail 170 is disposed. The secondary rails 170, four in all, extend in a straight line. The secondary rail 170 is of the length equal to the width of the sliding door 3 minus a gap between the pair of the support brackets 171. The secondary rail 170 is fixed between the support brackets 171. As shown in FIG. 28, the secondary rail 170 includes a guide groove 170*a* (secondary track) which is open to the bottom. Both side surfaces of the guide groove 170*a* are vertical. The guide groove 170*a* has a narrow space 170*b* formed at an upper portion thereof. The guide groove 170*a* and the space 170*b* are of the same shape as the guide groove 120*f* and the space 120*g* of the support bracket 120 of the sliding door 3, respectively.

Operation of the guide apparatus according to the seventh embodiment will now be described. When all of a plurality of (four, for example) the openings 2*x* are closed by corresponding sliding doors 3, the front surface of the sliding doors 3 are flush with each other as in the first embodiment.

When the sliding door 3 is in the closed position, as shown in FIG. 21, the rotatable rail 81 is in the horizontal down position and the roller 88 is down and received in the receiving groove 82 of the rotatable rail 81. The roller 88 rides on the first surface 82*a* (supporting surface) with a side surface thereof abutting the first surface 82*a*, thereby the weight of the sliding door 3 is supported. The support bracket 86 is provided with rotation torque by an elastic force of the torsion spring 87. The rotation torque biases the sliding door 3 towards the closed position, thereby maintaining the sliding door 3 in the closed position.

When the sliding door 3 is in the closed position, the additional track 81*x* and the restriction wall 81*y* of the rotatable rail 81 and the second and the third parts 86*y*, 86*z* of the support bracket 86 define a space 180 for the roller 88 of other sliding doors 3 to run therein.

When all the sliding doors 3 are in the closed position, additional tracks 81*x* of all the rotatable rails 81 are arranged in a straight line constituting a continuous track.

Figure 26:
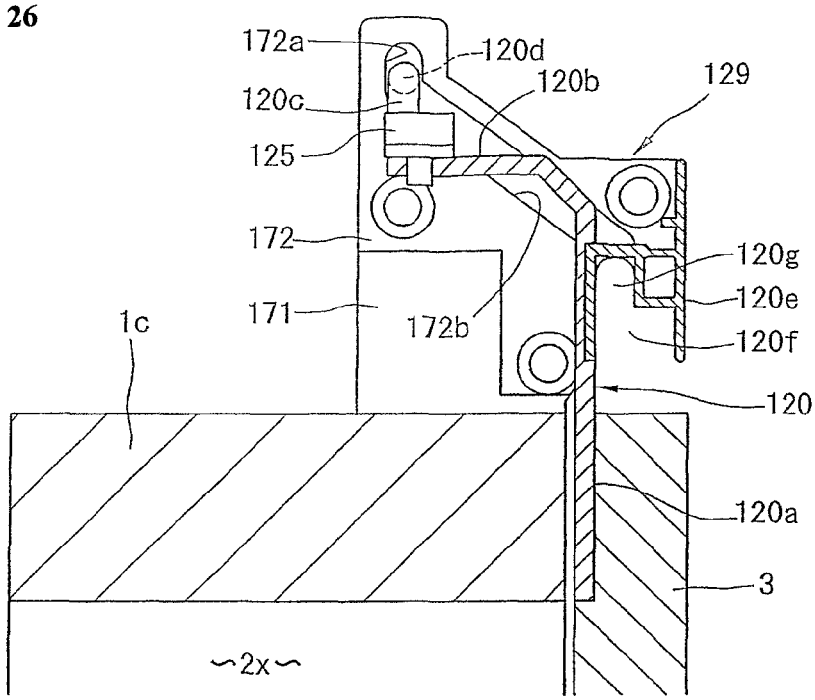
FIG. 26 is a vertical sectional view of an upper structure of a guide apparatus according to the seventh embodiment when the sliding door is in the closed position.
Figure 29:
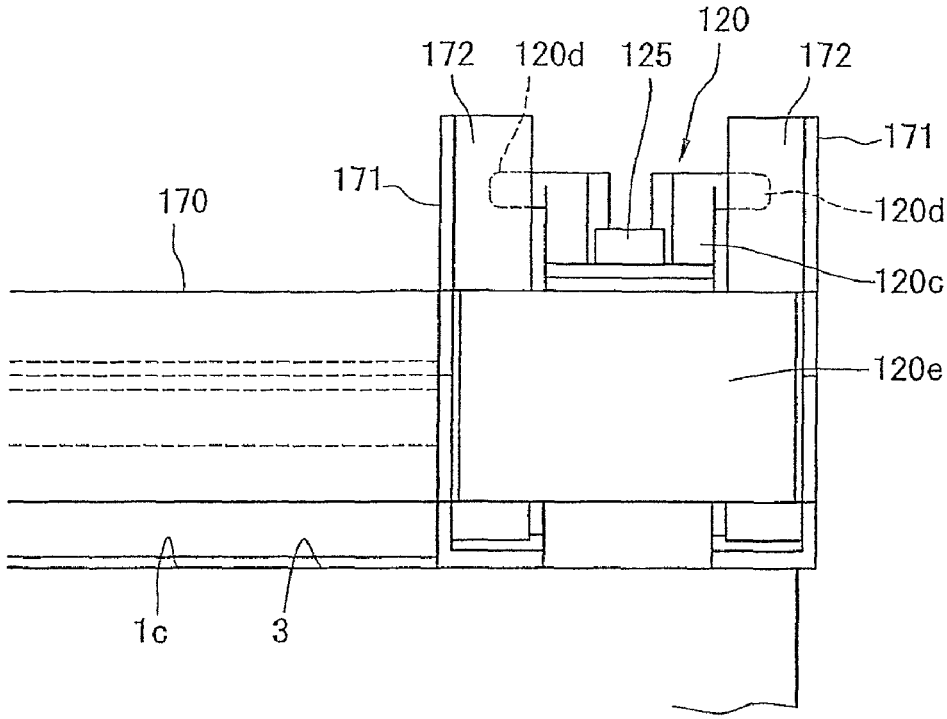
FIG. 29 is a front view of the upper structure of the guide apparatus for guiding the sliding door according to the seventh embodiment of the present invention when the sliding door is in the closed position.
Figure 30:
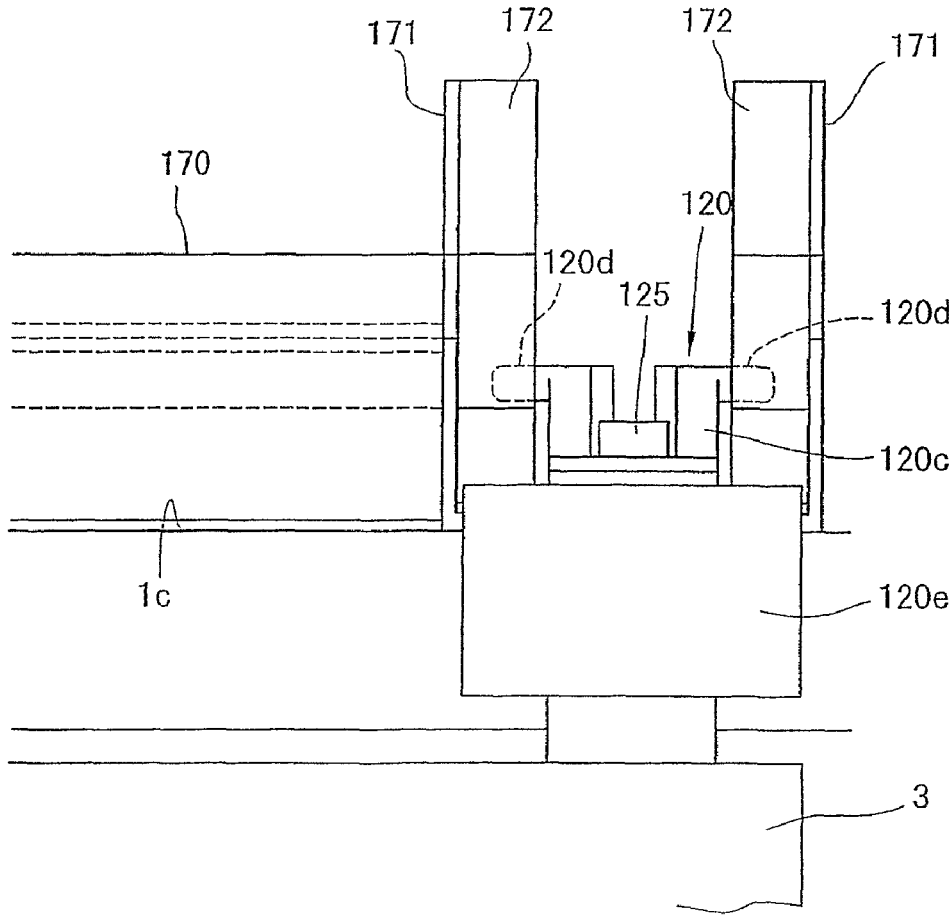
FIG. 30 is a front view of the upper structure of the guide apparatus according to the seventh embodiment when the sliding door is in the opening preparation position.

On the other hand, as shown in FIGS. 26 and 29, the support bracket 120 mounted on the upper edge portion of the sliding door 3 is received between a pair of the guide plates 172 when the sliding door 3 is in the closed position. The left and right projections 120*d* of the support bracket 120 is located in the vertical groove 172*a* of the pair of the guide plates 172 and is prohibited from moving in a front and rear direction. The guide groove 120*f* of the support bracket 120 is continuous with the guide groove 170*a* of the secondary rail 170 via a slight gap.

Opening movement of selected one of the sliding doors 3 will now be described. The pulls are grabbed and the sliding door 3 is pulled out to the opening preparation position located in the front. When the sliding door 3 is being pulled out, the roller 88 of the sliding door 3 engages with the receiving groove 82 of the rotatable rail 81, and thereby the rotatable rail 81 is rotated forward, taking a vertical standing position. At that time the support bracket 86 rotates 90 degrees against the torsion spring 87, allowing the roller 88 to stand up. Accompanying the rotation of the rotatable rail 81, the additional track 81*x* of the rotatable rail 81 comes away from the continuous track, and instead an auxiliary track 82*b* of the rotatable rail 81 becomes a part of the continuous track. The roller 88 rides on the auxiliary track 82*b* of the rotatable rail 81, with a circumferential surface thereof abutting the auxiliary track 82*b*.

At a certain point while the sliding door 3 is moving from the closed position to the opening preparation position, torque by the weight of the sliding door 3 surpasses torque by the torsion spring 87, allowing the sliding door 3 to move to the opening preparation position by its own weight. As shown in FIG. 22, the engaging portion 81*z* of the rotatable rail 81 abuts with the load receiving portion 80*a* of the support bracket 80, thereby stopping the sliding door 3 at the opening preparation position.

When the sliding door 3 moves from the closed position to the opening preparation position, being supported by the rotatable rail 81, it is displaced downward. As the sliding door 3 makes this movement, in the upper structure of the guide apparatus, the projection 120*d* of the support bracket 120 moves diagonally forward along the inclined groove 172*b* of the guide plate 172 up to the cutout 172*c*. In this way, the upper edge portion of the sliding door 3 moves stably while the sliding door 3 moves to the opening preparation position. When the sliding door 3 reaches the opening preparation position and the projection 120*d* of the support bracket 120 is engaged with the cutout 172*c*, the roller 125 of the support bracket 120 is located in a position corresponding to the guide groove 170*a* of the secondary rail 170.

When the sliding door 3 moves from the opening preparation position to the open position in the left or right, the roller 88 of the support bracket 85 comes away from the auxiliary track 51*x* of the rotatable rail 81, and as shown in FIG. 23, transfers onto the additional track 81*x* of the adjacent rotatable rail 81 corresponding to the adjacent sliding door 3. As is clear from this, the additional track 81*x* of the sliding door 3 in the closed condition constitutes a main track for the sliding door 3 moving to the open position, and the rotatable rails 81 corresponding to the sliding doors 3 in the closed position solely constitutes the main rail. As shown in FIG. 23, the roller 88 of the sliding door 3 moving to the open position runs in the space 180 defined by the support bracket 86 of the sliding door 3 in the closed position and the rotatable rail 81. The auxiliary roller 89 is guided by the restriction wall 81*y* and the engaging portion 81*z*.

When the sliding door 3 moves to the open position, as shown in FIG. 28, the roller 125 of the sliding door 3 runs in the guide groove 170*a* of the secondary rail 170 and a guide groove 120*f* of the support bracket 120 of the sliding door 3 in the closed condition. The standing portion 120*c* of the support bracket 120 of the sliding door 3 moving to the open position moves in the cutout 172*c* of the guide plate 172, the space 170*b* of the secondary rail 170 and the space 120*g* of the support bracket 120 of the sliding door 3 in the closed condition.

As shown in FIGS. 23 and 28, the sliding door in the open position is overlapped with one of the other sliding doors 3 in the closed position.

The rotatable rail 81 left by the sliding door 3 which has moved to the open position is maintained in the standing condition by the holding mechanism 83 as described earlier.

When the sliding door 3 moves back from the open position to the opening preparation position, it is positioned by the positioning mechanism 84. To be more specific, when the sliding door 3 is moved back to the opening preparation position from the right, for example, the support shaft 88*x* of the roller 88 abuts with the inclined guiding surface 84*x* on the right side of the movable member 84*b* of the positioning mechanism 84, thereby inclining the movable member 84*b* right up. When the sliding door 3 moves further, the roller 88 engages with an engagement surface 84*y*, positioning the sliding door 3 in the opening preparation position.

When the sliding door 3 is pushed to the rear, the support bracket 86 and the rotatable rail 81 rotates 90 degrees respectively, going back to the state illustrated in FIG. 21. To be brought back to the closed position, the sliding door 3 initially needs to be lifted with a force equivalent to the weight of the sliding door 3 minus the biasing force of the torsion spring 87. From a certain point, however, it reaches automatically to the closed position by the force of the torsion spring 87.

Other modes of operation are similar to those of other embodiments described earlier.

Figure 31:
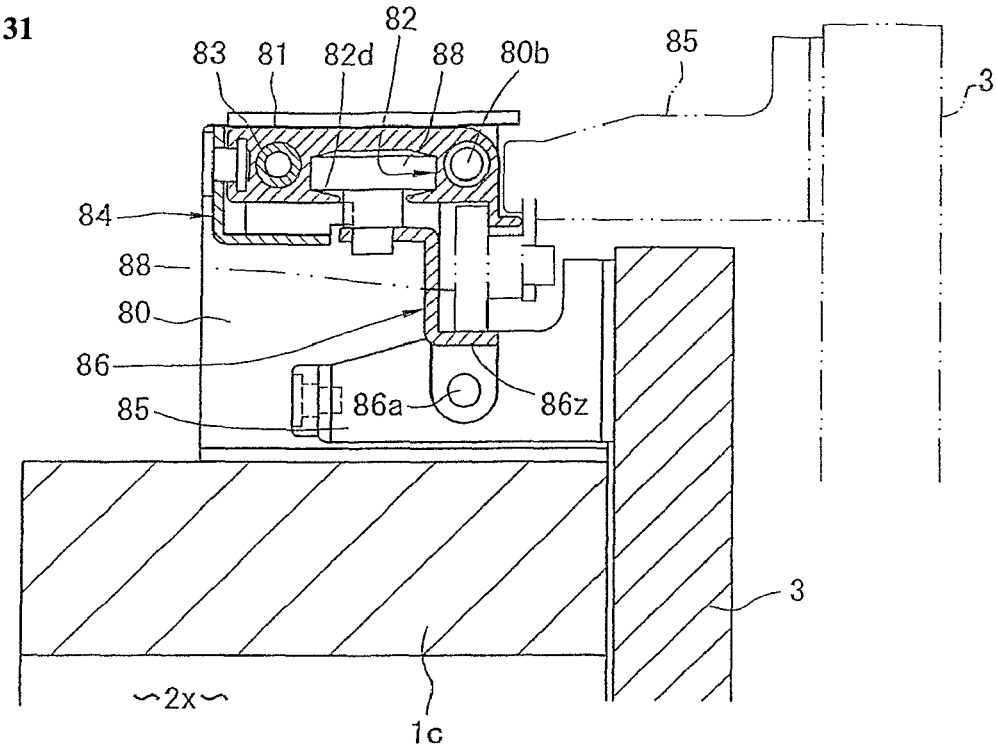
FIG. 31 is a vertical sectional view of an upper structure of a guide apparatus according to an eighth embodiment of the present invention when the sliding door is in the closed position.
Figure 32:
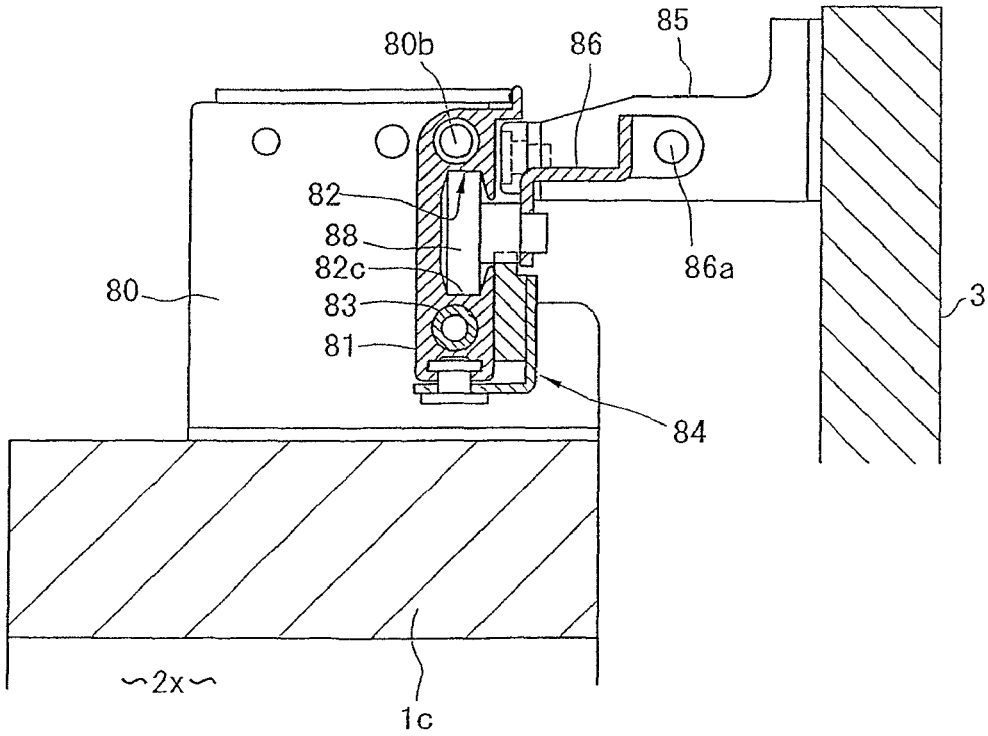
FIG. 32 is a vertical sectional view of the upper structure of the guide apparatus according to the eighth embodiment when the sliding door is in the opening preparation position.
Figure 33:
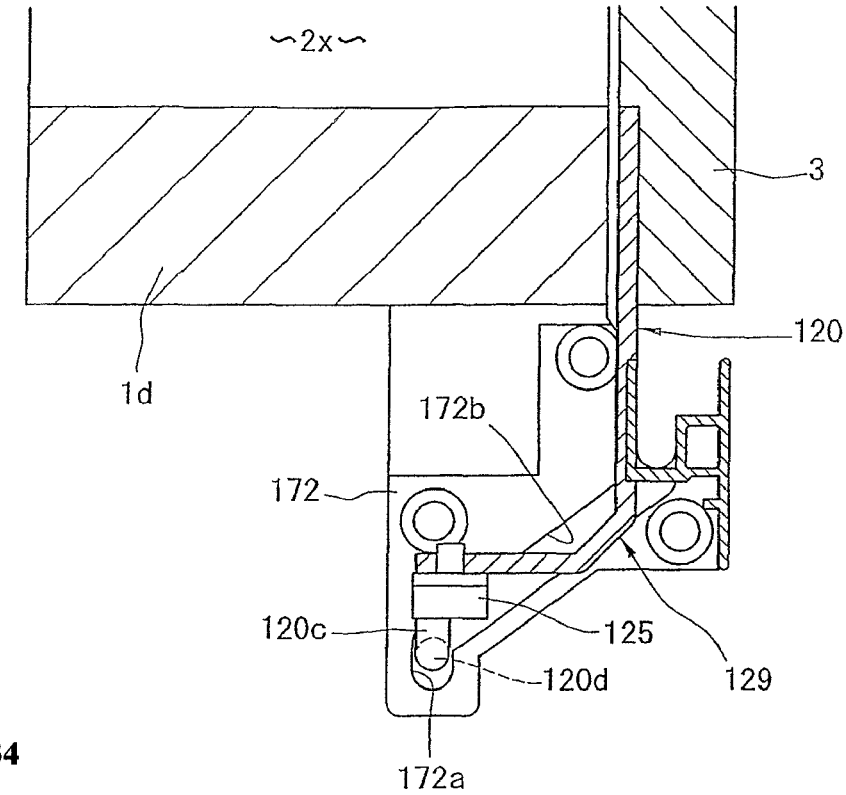
FIG. 33 is a vertical sectional view of a lower structure of the guide apparatus according to the eighth embodiment when the sliding door is in the closed position.
Figure 34:
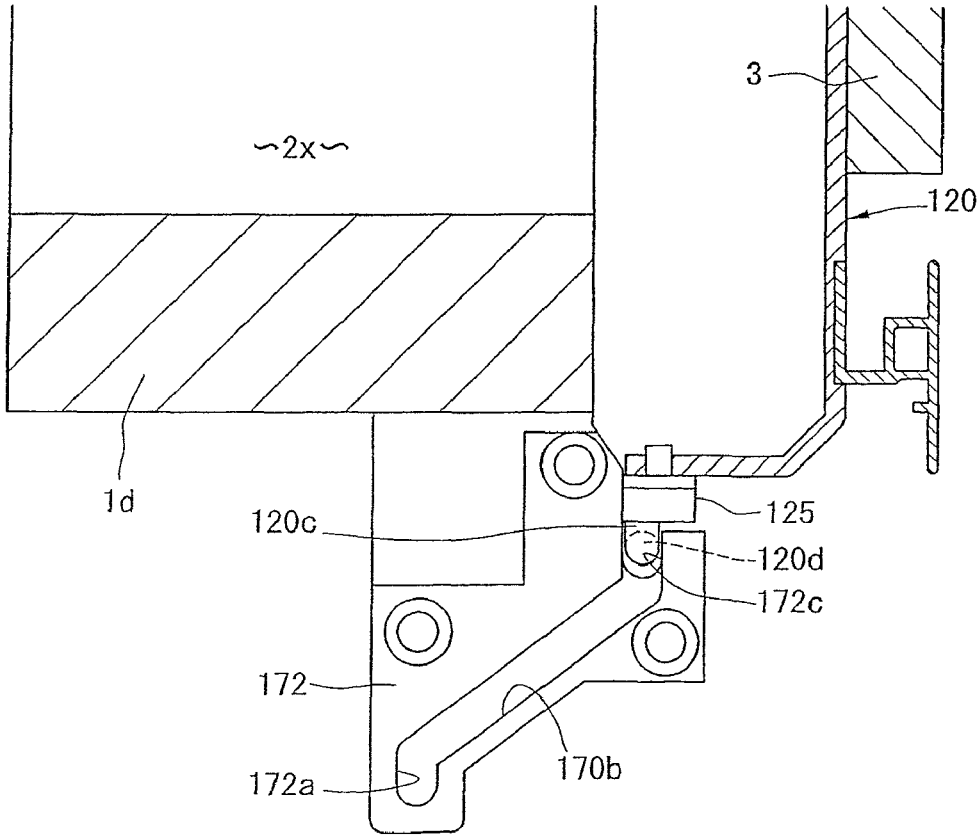
FIG. 34 is a vertical sectional view of the lower structure of the guide apparatus according to the eighth embodiment when the sliding door is in the opening preparation position.

An eighth embodiment of the present invention will now be described with reference to FIGS. 31 to 36. In this embodiment, an upper structure and a lower structure are similar to those of the seventh embodiment, but are arranged upside down. The sliding door 3 moves upward when it moves from the closed position to the opening preparation position. To ensure this movement, as shown in FIGS. 33 and 34, the inclined groove 172*b* of the guide plate 172 is inclined upward to the front. The eighth embodiment is different from the seventh embodiment in the following points: As shown in FIG. 31, when the sliding door 3 is in the closed position, the side surface of the roller 88 in the down position abuts with the fourth surface 82*d* of the receiving recess 82. That is, the fourth surface 82*d* serves as a supporting surface to support the roller 88. As shown in FIG. 32, when the sliding door 3 is in the opening preparation position, in the receiving groove 82 of the rotatable rail 81, the roller 88 in the standing position rides on the third surface 82*c* distanced from the center of rotation. In other words, the third surface 82*c* serves as an auxiliary track.

In another feature of this embodiment, the third part 86*z* of the support bracket 86 of the sliding door 3 in the closed position serves as an additional track for other sliding doors 3 moving to the open position.

Figure 35:
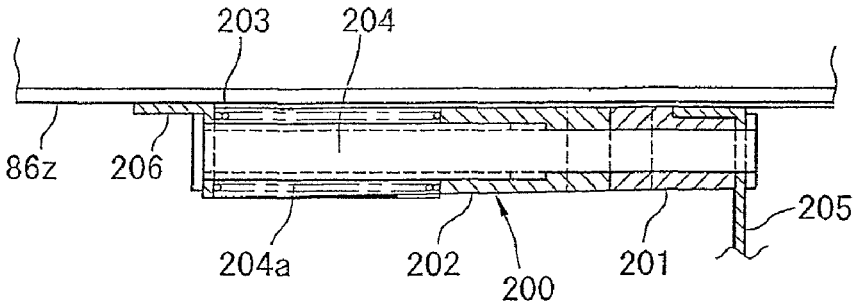
FIG. 35 is a horizontal sectional view of a biasing mechanism used in the eighth embodiment of the present invention.

In the eighth embodiment, instead of the torsion spring 87 of the seventh embodiment, a biasing mechanism 200 as shown in FIG. 35 is used to maintain the sliding door 3 in the closed position. The biasing mechanism 200 comprises a pair of cams 201, 202 of cylindrical shape, a compression coil spring 203, a shaft 204 and a pair of brackets 205, 206. One of the brackets 205 is fixed on the rear surface of the sliding door 3. One of the cams 201 is fixed on the bracket 205. The other bracket 206 is fixed on the third part 86*z* of the support bracket 86. A right portion of the shaft 204 is inserted into the bracket 205 and the cam 201 to be rotatably supported thereby. The shaft 204 has a key 204*a* extending in an axial direction provided on a circumferential surface in a left portion thereof. The key 204*a* is inserted into the bracket 206 and the cam 202 to be non-rotatably supported thereby. The shaft 204 is arranged on a straight line with the rotation shaft 86*a* of the support bracket 86.

Figure 36:
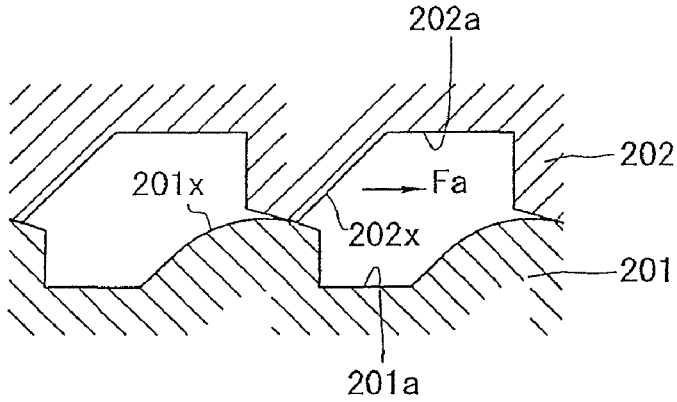
FIG. 36 is a developed view of cam surfaces of two cams of the biasing mechanism.
Figure 36:
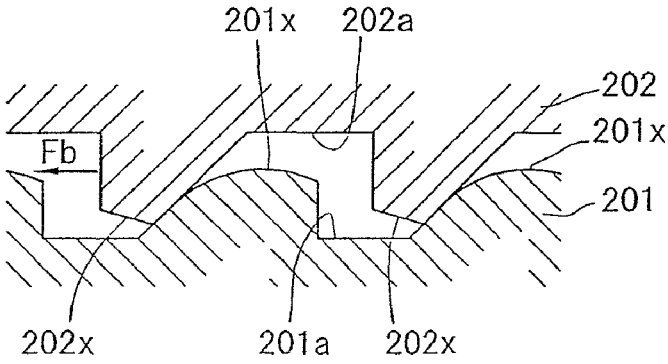

The coil spring 203, disposed between the cam 202 and the bracket 206, biases the cam 202 toward the cam 201. End surfaces of the cams 201 and 202 opposed to each other are cam surfaces 201*a* and 202*a* as shown in FIG. 36, abutted with each other forced by the coil spring 203. The cam surface 201*a* of the cam 201 includes two mountain portions 201*x* and the cam surface 202*a* of the cam 202 includes two mountain portions 202*x*.

When the sliding door 3 is in the closed position, as shown in FIG. 36(A), the mountain portion 202*x* of the cam 202 abuts with one of inclined planes of the mountain portion 201*x* of the cam 201, thereby converting the force of the coil spring 203 into rotational torque Fa in one direction. The rotational torque Fa biases the sliding door 3 to the rear, thereby maintaining the sliding door 3 securely in the closed position.

When the sliding door 3 is pulled to the front from the closed position to the opening preparation position, the support bracket 86 rotates, and consequently the cam 202 rotates with respect to the cam 201. When the cam 202 rotates more than predetermined degrees, 20 degrees, for example, the mountain portion 202*x* rides over the top of the mountain portion 201*x* to abut with the other inclined plane of the mountain portion 201*x*. As a result, as shown in FIG. 36(B), rotational torque Fb in the opposite direction to when the sliding door 3 is in the closed position is generated. The rotational torque Fb is applied to the sliding door 3 to bias the sliding door 3 upward (toward the opening preparation position) against its weight, thus maintaining the sliding door 3 securely in the opening preparation position.

Figure 37:
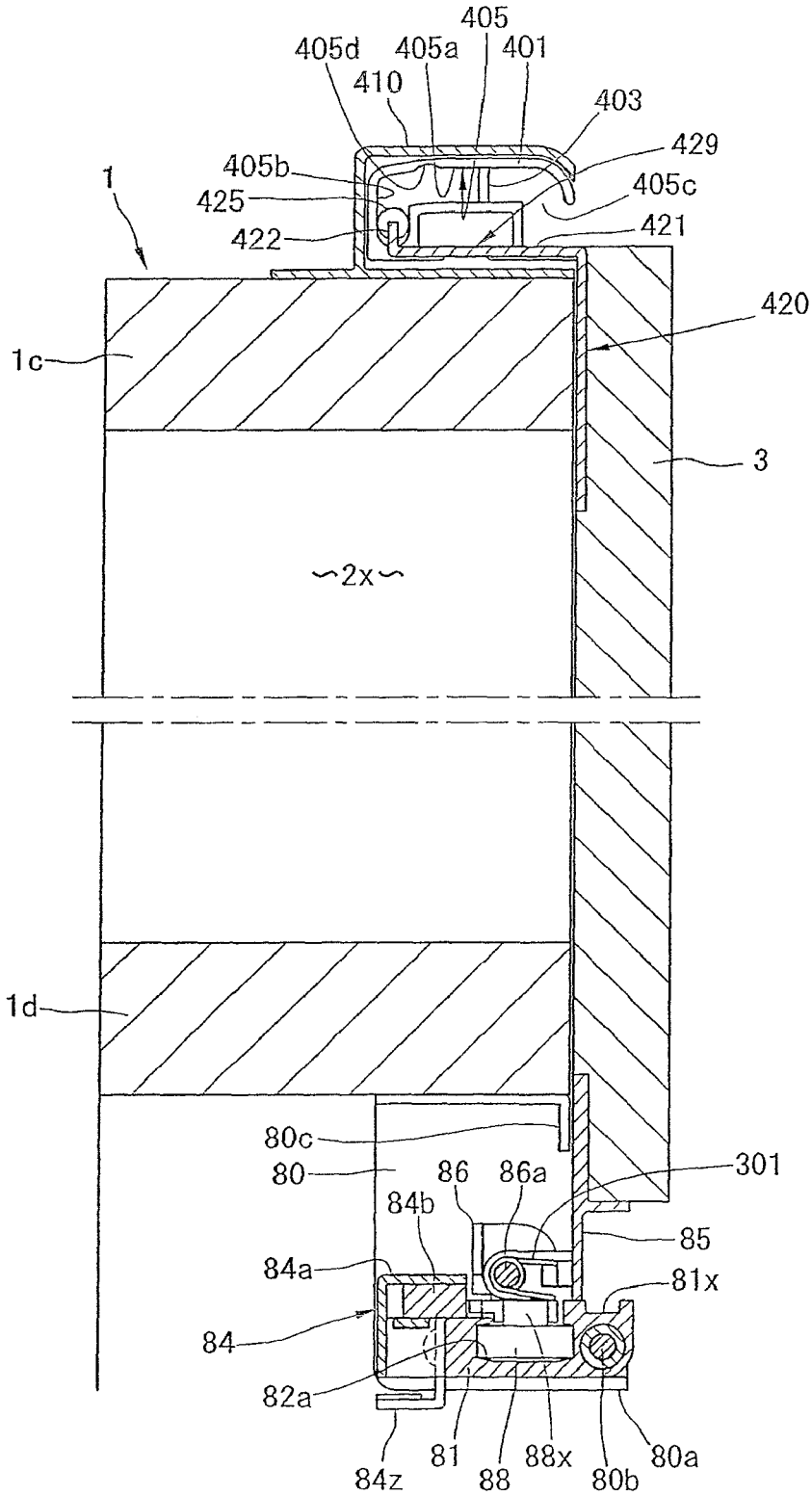
FIG. 37 is a vertical sectional view of a guide apparatus according to a ninth embodiment when the sliding door is in the closed position.
Figure 38:
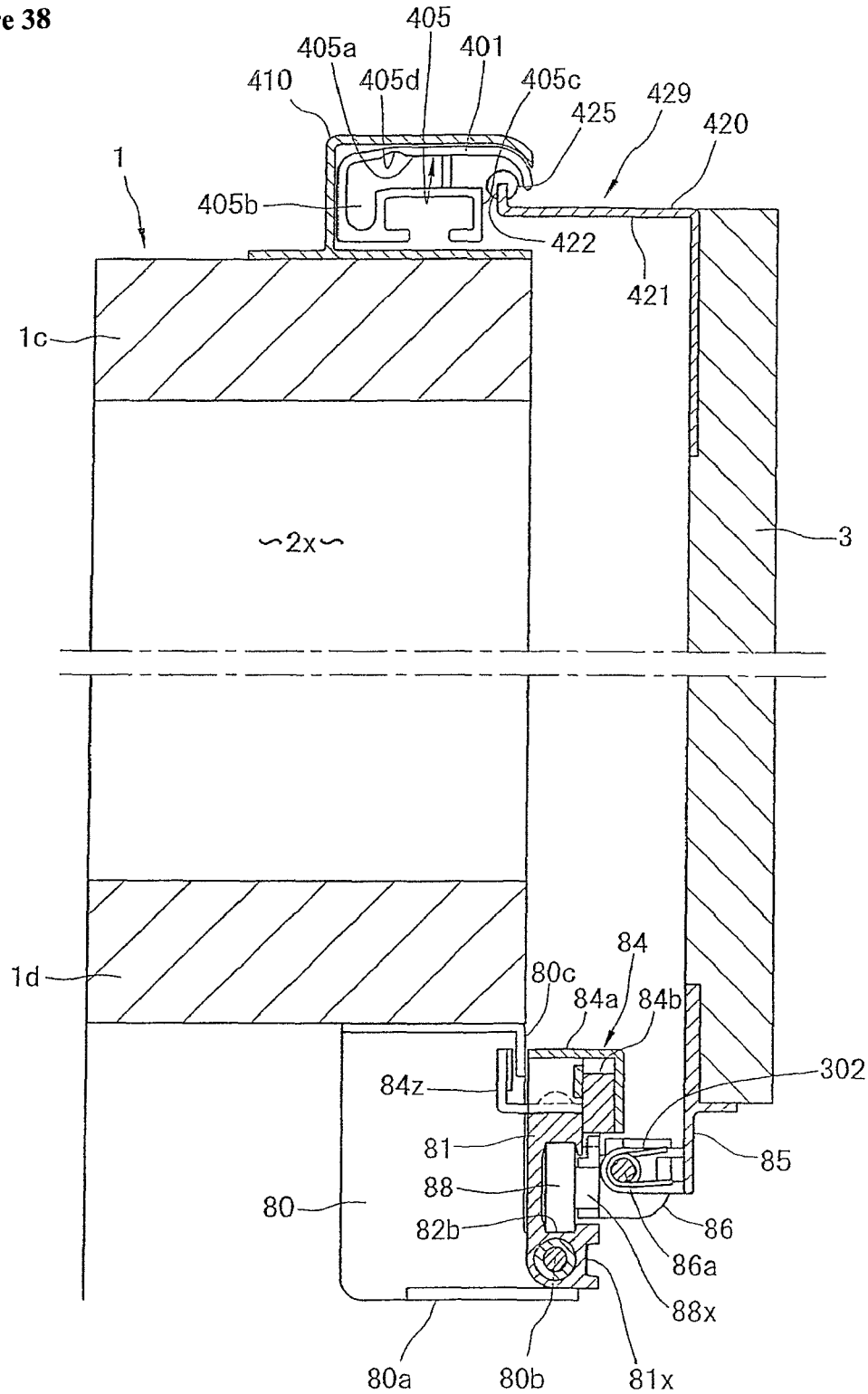
FIG. 38 is a vertical sectional view of the guide apparatus according to the ninth embodiment of the present invention when the sliding door is in the opening preparation position.
Figure 40:
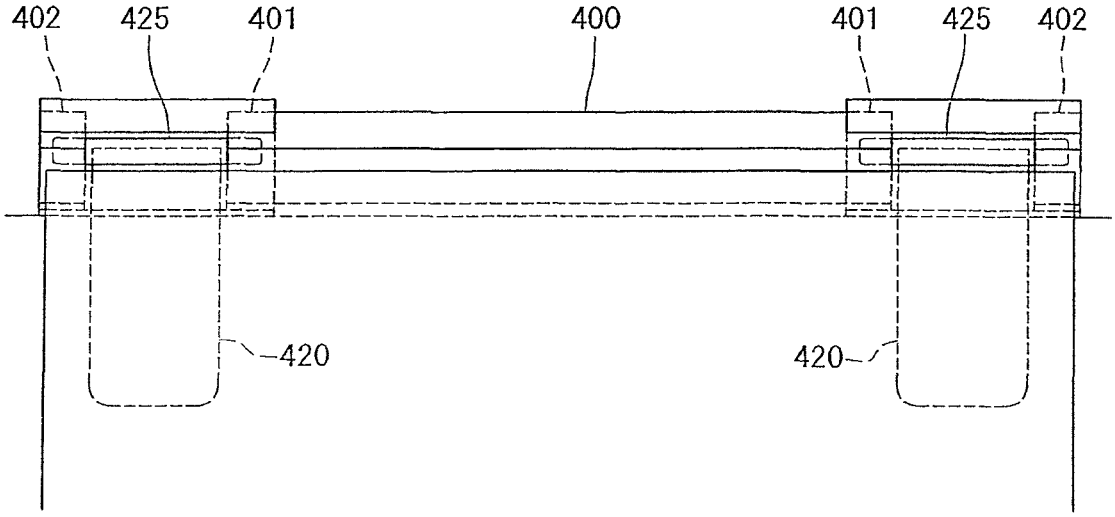
FIG. 40 is a front view of the upper structure of the guide apparatus according to the ninth embodiment when the sliding door is in the opening preparation position.
Figure 41:
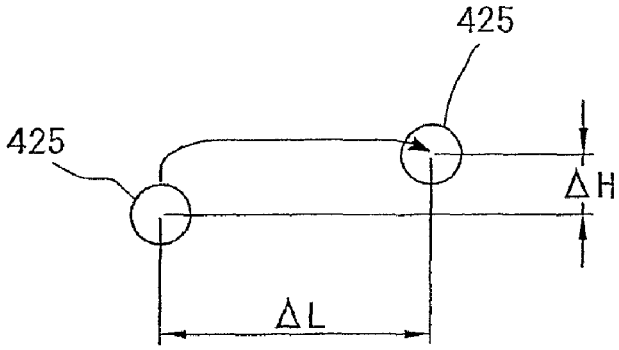
FIG. 41 is a schematic drawing showing a trajectory of a slider of a secondary runner while the sliding door is in the course of moving from the closed position to the opening preparation position.
Figure 42:
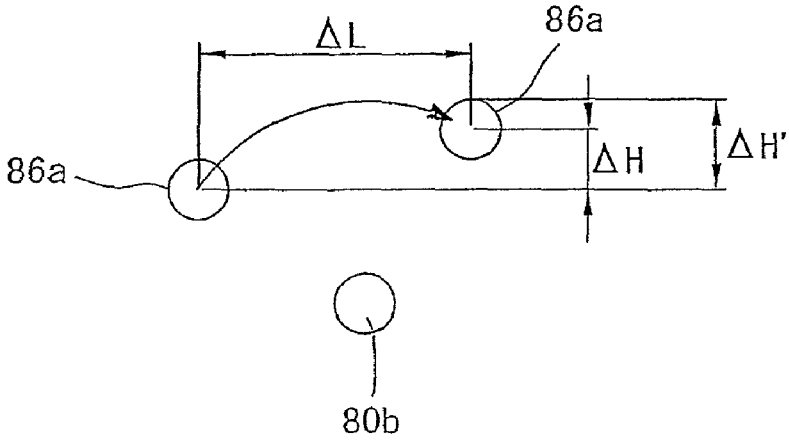
FIG. 42 is a schematic drawing showing a trajectory of a rotation axis of a runner support bracket while the sliding door is in the course of moving from the closed position to the opening preparation position.

A ninth embodiment will now be described with reference to FIGS. 37 to 42. This embodiment is of a similar construction to the seventh embodiment shown in FIGS. 21 to 30. The lower structure of the ninth embodiment is different from that of the seventh embodiment in the following points: As shown in FIG. 37, when the sliding door 3 is in the closed position and the rotatable rail 81 is in the first rotation position, the rotation shaft 86*a* of the support bracket 86 is positioned in the rear with respect to the rotation shaft 80*b* of the rotatable rail 81. On the other hand, when the sliding door 3 is in the opening preparation position and the rotatable rail 81 is in the second rotation position, as shown in FIG. 38, the rotation shaft 86*a* of the support bracket 86 is positioned in the front with respect to the rotation shaft 80*b* of the rotatable rail 81. Therefore, as shown in FIG. 42, while the sliding door 3 moves from the closed position to the opening preparation position, the rotation shaft 86*a* moves along an arc-shaped trajectory with the highest point reached when the rotation shaft 86*a* is above the rotation shaft 80*b*. This means that an amount of vertical displacement $\Delta H'$ of the rotation shaft 86*a*, that is the difference in height of the rotation shaft 86*a* between when it is in the highest point and when it is in the first rotation position, is smaller an amount of horizontal displacement $\Delta L$ of the rotation shaft 86*a* made during the movement of the rotational rail 81 from the first rotation position to the second rotation position. Difference in height $\Delta H$ of the rotation shaft 86*a* between when it is in the first rotation position and when it is in the second rotation position is smaller than $\Delta H'$. The lower edge portion of the sliding door 3 moves along the same trajectory as the rotation shaft 86*a*.

Other differences in the lower structure between the ninth embodiment and the seventh embodiment are as follows: A stopper 84*z* is formed on the holder 84*a*. The stopper 84*z* abuts with a drooping part 80*c* of the support bracket 80, thereby maintaining the rotatable rail 81 in the standing position. Two torsion springs 301, 302 are coiled around the rotation shaft 86*a* separately from each other in an axial direction. The torsion spring 301 shown in FIG. 37 biases the support bracket 86 clockwise and the torsion spring 302 shown in FIG. 38 biases the support bracket 86 counterclockwise. Therefore, before the sliding door 3 is installed to the main body 1, the roller 88 is maintained at a neutral position where the roller 88 is inclined with respcet to the sliding door 3, making installation work easy.

Figure 39:
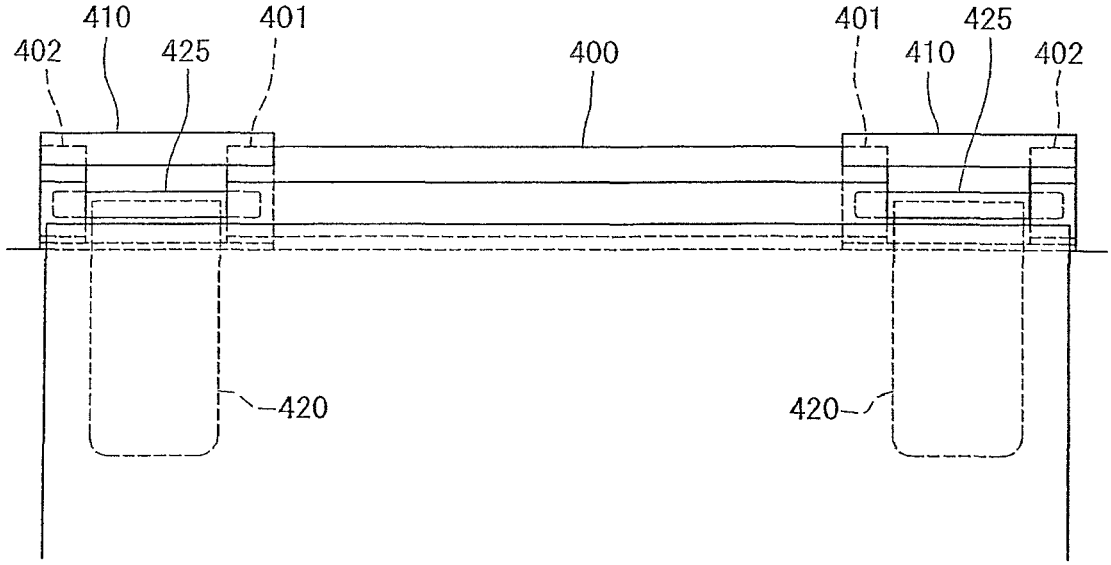
FIG. 39 is a front view of an upper structure of the guide apparatus according to the ninth embodiment when the sliding door is in the closed position.

The upper structure of the guide apparatus according to the ninth embodiment will now be described. As shown in FIGS. 39 and 40, both end parts of a secondary rail 400 serve as guide members 401 and the secondary rail 400 is fixed in the upper edge portion of the main body 1 via holders 410. At both ends of the upper edge portion of the main body 1, small guide members 402 are fixed by the holders 410. The guide member 402 and the guide member 401 are separated in a left and right direction opposed to each other and the secondary rail 400 and the guide member 402 are made of an extruded material of the same cross-sectional configuration.

As shown in FIGS. 37 and 38, on an opposing surface of the guide member 401, 402 opposed to each other, a partition wall portion 403 is cut off to form a guide groove 405. The guide groove 405 includes a horizontal portion 405*a* and a vertical portion 405*b* (back-end portion) continuing from a rear end of the horizontal portion 405*a*. A front end of the horizontal portion 405*a* is slightly bent down and continues to an opening section 405*c*. On an upper surface of the horizontal portion 405*a* nearer to the rear end thereof, an arc-shaped recess 405*d* is formed.

On the upper edge portion of the sliding door 3, a support bracket 420 is fixed. The support bracket 420 includes a horizontal portion 421 and the standing portion 422. On an upper end of the standing portion 422, a column-shaped slider 425 (running portion) is fixed. Both end portions of the slider 425 is provided as projections projecting to the left and right. When the sliding door 3 is located between the closed position and the opening preparation position, the horizontal portion 421 is located between the guide members 401 and 402 and the slider 425 is located in the guide groove 405. The support bracket 420 and the slider 425 constitute a secondary runner 429.

Operation of the guide apparatus according to the ninth embodiment will now be described. As shown in FIG. 37, when the sliding door 3 is in the closed position, the rotatable rail 81 is in the down position and the slider 425 is located at the lower end of the vertical portion 405*b* of the guide groove 405. When the sliding door 3 is pulled to the front to the opening preparation position, the rotatable rail 81 rotates to stand up, thereby standing up the roller 88. During the process, the rotation shaft 86*a* of the support bracket 86 moves along the arc-shaped trajectory having the highest point in the middle as mentioned earlier. During this time, the slider 425 moves upward along the vertical portion 405*b* of the guide groove 405, then forward along the horizontal portion 405*a*, then slightly downward to reach the opening section 405*c*. As shown in FIG. 41, amount of horizontal displacement of the slider 425 is equal to amount of horizontal displacement $\Delta L$ of the rotation shaft 86*a* of the support bracket 86 in the lower structure and amount of vertical displacement of the slider 425 is equal to the difference in height $\Delta H$ of the rotation shaft 86*a* between when it is in the first rotation position and when it is in the second rotation position. Since the amount of vertical displacement of the slider 425 $\Delta H$ is thus reduced, the height of the guide members 401 and 402 can be low, thereby contributing to reduce dimensions of the guide apparatus as a whole.

As is clear from the description given above, the trajectory of the rotation shaft 86*a* of the support bracket 86, that is the trajectory of the lower edge portion of the sliding door 3, is different from a trajectory of the slider 425, that is a trajectory of the upper edge portion of the sliding door 3. The difference in the trajectories is compensated by the slight inclination of the sliding door 3. When the rotation shaft 86*a* is near the highest point of the arc-shaped trajectory thereof, inclination of the sliding door 3 is reduced by the entrance of the slider 425 into the recess 405*d* of the guide groove 405.

As with the seventh embodiment, when moving from the opening preparation position to the open position, the sliding door 3 rides on the additional track 81*x* of the rotatable rail 81 of other sliding doors in the closed position. In doing so, the slider 425 runs in the opening section 405*c* of the secondary rail 400, that is on the secondary track. The opening section 405*c* is located above and is further from the main body 1 than the support bracket 420 of the sliding door 3 in the closed position. Therefore, the support bracket 420 of the sliding door 3 moving to the open position and the support bracket 420 of the sliding door 3 in the closed position do not interfere with each other.

The structures of the guide apparatus according to the seventh to the ninth embodiment as described above, may be used for opening and closing a single sliding door 3. In that case, a rail member having a fixed track shall be used as a main track.

All the embodiments mentioned above may be applicable to an apparatus for opening and closing an opening section of other structures such as a house, a closet, furniture and a large refrigerator as well. Opening sections corresponding to a plurality of sliding doors may be divided from each other.

An opening preparation position of a sliding door may be in the rear of a closed position. In such a case, the sliding door is pushed to the rear to be moved to the opening preparation position from the closed position.

The continuous track may be in a shape of an arc having a large curvature. In such a case, it is preferable that a cross-section of the sliding door is in a shape of an arc matching to the shape of a rail.

The slider, instead of the roller, may be mounted on the sliding door as the main runner.

When applying the present invention to an apparatus for guiding a single sliding door to open and close a window, the sliding door may be flush with a door case in a closed position and be received in the door case in an open position.

The present invention can be applied not only to a sliding door for opening and closing an opening section, but also to a panel (plate-like object) supported on a wall surface to guide movement thereof.

The features of the above mentioned embodiments may be combined as appropriate.

INDUSTRIAL APPLICABILITY

As set forth above, according to the present invention, a plate-like object can be guided between a set position and a preparation position, and between the preparation position and a non-set position in a simple structure relatively free from failure.

The invention claimed is:

1. A guide apparatus for guiding a movement of a plurality of doors with respect to a main body between a set position and a preparation position that is in front of or behind said set position and between said preparation position and a non-set position positioned at a side of said preparation position, wherein said plurality of doors are flush with each other in said set position and when arranged side by side, said guide apparatus comprising:

a roller mounted on at least one of upper and lower edge portions of each of said plurality of doors; and a plurality of rotatable rails having a length approximately equal to a width of said plurality of doors and arranged in a line extending horizontally in a left and right direction, wherein each of said plurality of rotatable rails is supported by said main body such that said plurality of rotatable rails rotate between a first rotation position and a second rotation position about a first rotation axis extending horizontally in the left and right direction, wherein each of said plurality of rotatable rails includes a supporting surface, an auxiliary track, and an additional track, wherein in said first rotation position, each of said plurality of rotatable rails supports a corresponding one of said plurality of doors in said set position by making said roller ride on said supporting surface, wherein in said second rotation position, each of said plurality of rotatable rails supports a corresponding one of said plurality of doors in said preparation position by making said roller ride on said auxiliary track, and wherein when one of two adjacent ones of said plurality of rotatable rails is in said second rotation position, a surface of said auxiliary track of said one of two adjacent ones of said plurality of rotatable rails is coplanar to a surface of said additional track of the other of said two adjacent ones of said plurality of rotatable rails in said first rotation position.

2. The guide apparatus according to claim 1, wherein:

said main body has opening sections formed therein, each of said opening sections is closed by a corresponding one of said plurality of doors in said set position, and each of said opening sections is open when a corresponding one of said plurality of doors is in said non-set position.

3. The guide apparatus according to claim 1 further comprising:

a holding mechanism for holding each of said rotatable rails in said second rotation position.

4. A guide apparatus according to claim 1 wherein:

a rotatable member has a rail portion formed on a distal edge thereof, said rail portion having a substantially circular cross-section and extending parallel to said main track;

a second supporting surface comes to the top of a circumferential surface of said rail portion when said rotatable member is in said first rotation position;

a second auxiliary track comes to the top of said circumferential surface of said rail portion when said rotatable member is in said second rotation position; and a runner includes a fitting groove into which said rail portion is to be fitted.

5. A guide apparatus according to claim 4 further comprising:

a biasing member for biasing said rotatable member to said first rotation position and thus biasing said plate-like object to said set position.

6. A guide apparatus according to claim 1 or 4 wherein:

a plurality of said plate-like objects are provided;

all of said plate-like objects are flush with each other when they are all in said set position and arranged side by side with each other;

each of said plate-like objects is provided with a rail member including a second additional track of the same length as said second auxiliary track of said rotatable member; and said rail member of each one of said plate-like objects in said set position serves as at least a part of said main rail for the other of said plate-like objects.

7. A guide apparatus according to claim 6 wherein:

said main body is provided with a fixed rail extending to the left and right: and said main rail comprises said fixed rail and said rail member of said plate-like object in said set position.

8. A guide apparatus according to claim 6 wherein:

the length of said rail member of said plate-like object is generally the same as the width of said plate-like object; and said main rail is composed solely of said rail member of said plate-like object in said set position.

9. The guide apparatus according to claim 1, wherein:

at least one of said plurality of rotatable rails includes a receiving groove extending in a longitudinal direction of said rotatable rail;

an inner surface of said receiving groove includes said supporting surface and said auxiliary track; and said roller is received in said receiving groove when a corresponding one of said plurality of doors is in said set position and in said preparation position.

10. The guide apparatus according to claim 9 wherein:

a support bracket is rotatably connected to said corresponding one of said plurality of doors in such a way that said support bracket rotates about a second rotation axis parallel to said first rotation axis; and said roller is supported in said support bracket.

11. The guide apparatus according to claim 10 wherein:

said roller is of a disc shape and is turnably supported in a distal end portion of said support bracket, so that said roller lies with a side surface thereof abutting said supporting surface of said receiving groove when said rotatable rail is in said first rotation position and said roller stands up with a circumferential surface thereof abutting said auxiliary track when said rotatable rail is in said second rotation position.

12. A guide apparatus according to claim 10 or 11 wherein:

said second rotation axis of said support bracket is located behind said first rotation axis of said rotatable rail when said rotatable rail is in said first rotation position; and said second rotation axis of said support bracket is located in front of said first rotation axis of said rotatable rail when said rotatable rail is in said second rotation position.

13. The guide apparatus according to claim 11 further comprising:

a biasing member which applies rotation torque to said support bracket, thereby biasing said corresponding one of said plurality of doors to said set position.

14. A guide apparatus according to claim 1 or 9 wherein:

a plurality of said plate-like objects are provided;

all of said plate-like objects are flush with each other when they are all in said set position and arranged side by side with each other;

said support bracket is mounted on each of said plate-like objects;

said support bracket includes a third additional track of the same length as a third auxiliary track; and said third additional track of said support bracket corresponding to each one of said plate-like objects serves as at least a part of a second main rail for the other of said plate-like objects when a second rotatable member is in said first rotation position.

15. A guide apparatus according to claim 4 wherein:

said runner is disposed in an upper edge portion of said plate-like object; and said plate-like object is suspendedly supported by said rotatable member when said plate-like object is in said set position or in said preparation position.

16. The guide apparatus according to claim 1 wherein:

said roller is disposed in either said upper or lower edge portion of said plurality of doors;

a secondary runner is disposed in the other of said upper and lower edge portions of said plurality of doors; and the guide apparatus further comprises: a guide member which guides said secondary runner when said plurality of doors move between said set position and said preparation position; and a secondary rail which guides said secondary runner when said plurality of doors move between said preparation position and said non-set position.

17. The guide apparatus according to claim 16, wherein:

said secondary runner includes a projection projecting at least either to the left or right; and said guide member includes a guide groove which guides said projection.

18. The guide apparatus according to claim 17, wherein:

said secondary runner includes a running portion which runs in a groove formed in said secondary rail and a running portion support bracket which is mounted on said plurality of doors to support said running portion; and said running portion support bracket is provided with said projection.

19. The guide apparatus according to claim 17, wherein:

said plurality of doors move upward or downward while said plurality of doors move between said set position and said preparation position; and said guide groove of said guide member is linearly inclined corresponding to the displacement of said plurality of doors.

20. The guide apparatus according to claim 19 wherein:

said guide member includes a vertical groove continuous with said guide groove; and said projection of said secondary runner is received in said vertical groove when said plurality of doors are in said set position.

21. A guide apparatus according to claim 17 wherein:

said plate-like object takes the highest or the lowest position while moving from said set position to said preparation position; and said guide groove includes a horizontal portion extending in a front and rear direction and a back end portion extending upward or downward from a rear end of said horizontal portion.

22. The guide apparatus according to claim 16 wherein:

said secondary runner includes a rail portion which is continuous with said secondary rail when said plurality of doors are in said set position.

* * * * *